US007191617B2

(12) United States Patent
Cuellar et al.

(10) Patent No.: US 7,191,617 B2
(45) Date of Patent: Mar. 20, 2007

(54) HYDROCARBON GAS PROCESSING

(75) Inventors: Kyle T. Cuellar, Katy, TX (US); John D. Wilkinson, Midland, TX (US); Joe T. Lynch, Midland, TX (US); Hank M. Hudson, Midland, TX (US)

(73) Assignee: Ortloff Engineers, Ltd., Midland, TX (US)

( * ) Notice: Subject to any disclaimer, the term of this patent is extended or adjusted under 35 U.S.C. 154(b) by 0 days.

(21) Appl. No.: 11/201,358

(22) Filed: Aug. 10, 2005

(65) Prior Publication Data

US 2006/0032269 A1 Feb. 16, 2006

Related U.S. Application Data

(63) Continuation of application No. PCT/US2004/004206, filed on Feb. 12, 2004.

(60) Provisional application No. 60/449,772, filed on Feb. 25, 2003.

(51) Int. Cl.
*F25J 3/00* (2006.01)

(52) U.S. Cl. ..... 62/628; 62/630; 62/632

(58) Field of Classification Search ..... 62/620, 62/630, 628, 632
See application file for complete search history.

(56) References Cited

U.S. PATENT DOCUMENTS

| | | | |
|---|---|---|---|
| 2,952,984 A | 9/1960 | Marshall | 62/622 |
| 3,292,380 A | 12/1966 | Bucklin | 62/20 |
| 3,837,172 A | 9/1974 | Markbreiter et al. | 62/621 |
| 4,061,481 A | 12/1977 | Campbell et al. | 62/621 |
| 4,140,504 A | 2/1979 | Campbell et al. | 62/621 |
| 4,157,904 A | 6/1979 | Campbell et al. | 62/623 |

(Continued)

FOREIGN PATENT DOCUMENTS

WO 01/88447 A1 11/2001

OTHER PUBLICATIONS

U.S. Appl. No. 09/677,220, filed Oct. 2000, Wilkinson et al.

(Continued)

*Primary Examiner*—William C. Doerrler
(74) *Attorney, Agent, or Firm*—Fitzpatrick, Cella, Harper & Scinto

(57) ABSTRACT

A process for the recovery of ethane, ethylene, propane, propylene, and heavier hydrocarbon components from a hydrocarbon gas stream is disclosed. The stream is cooled and divided into first and second streams. The first stream is further cooled to condense substantially all of it and is thereafter expanded to the fractionation tower pressure and supplied to the fractionation tower at a first mid-column feed position. The second stream is expanded to the tower pressure and is then supplied to the column at a second mid-column feed position. A distillation stream is withdrawn from the column below the feed point of the second stream and is then directed into heat exchange relation with the tower overhead vapor stream to cool the distillation stream and condense at least a part of it, forming a condensed stream. At least a portion of the condensed stream is directed to the fractionation tower as its top feed. The quantities and temperatures of the feeds to the fractionation tower are effective to maintain the overhead temperature of the fractionation tower at a temperature whereby the major portion of the desired components is recovered.

46 Claims, 7 Drawing Sheets

U.S. PATENT DOCUMENTS

| | | | | |
|---|---|---|---|---|
| 4,171,964 | A | 10/1979 | Campbell et al. | 62/621 |
| 4,185,978 | A | 1/1980 | McGalliard et al. | 62/634 |
| 4,251,249 | A | 2/1981 | Gulsby | 62/621 |
| 4,278,457 | A | 7/1981 | Campbell et al. | 62/621 |
| 4,445,917 | A | 5/1984 | Chiu | 62/625 |
| 4,519,824 | A | 5/1985 | Huebel | 62/621 |
| 4,525,185 | A | 6/1985 | Newton | 62/612 |
| 4,545,795 | A | 10/1985 | Liu et al. | 62/613 |
| 4,600,421 | A | 7/1986 | Kummann | 62/621 |
| 4,617,039 | A | 10/1986 | Buck | 62/621 |
| 4,687,499 | A * | 8/1987 | Aghili | 62/621 |
| 4,689,063 | A | 8/1987 | Paradowski et al. | 62/627 |
| 4,690,702 | A | 9/1987 | Paradowski et al. | 62/621 |
| 4,707,170 | A | 11/1987 | Ayres et al. | 62/627 |
| 4,710,214 | A | 12/1987 | Sharma et al. | 62/621 |
| 4,755,200 | A | 7/1988 | Liu et al. | 62/612 |
| 4,851,020 | A | 7/1989 | Montgomery, IV | 62/621 |
| 4,854,955 | A | 8/1989 | Campbell et al. | 62/621 |
| 4,869,740 | A | 9/1989 | Campbell et al. | 62/621 |
| 4,889,545 | A | 12/1989 | Campbell et al. | 62/621 |
| 4,895,584 | A | 1/1990 | Buck et al. | 62/621 |
| RE33,408 | E | 10/1990 | Khan | 62/29 |
| 5,114,451 | A | 5/1992 | Rambo et al. | 62/623 |
| 5,275,005 | A * | 1/1994 | Campbell et al. | 62/621 |
| 5,291,736 | A | 3/1994 | Paradowski | 62/613 |
| 5,363,655 | A | 11/1994 | Kikkawa et al. | 62/613 |
| 5,365,740 | A | 11/1994 | Kikkawa et al. | 62/613 |
| 5,555,748 | A | 9/1996 | Campbell et al. | 62/621 |
| 5,566,554 | A | 10/1996 | Vijayaraghavan et al. | 62/621 |
| 5,568,737 | A | 10/1996 | Campbell et al. | 62/621 |
| 5,600,969 | A | 2/1997 | Low | 62/622 |
| 5,615,561 | A | 4/1997 | Houshmand et al. | 62/611 |
| 5,651,269 | A | 7/1997 | Prevost et al. | 62/613 |
| 5,755,114 | A | 5/1998 | Foglietta | 62/618 |
| 5,755,115 | A | 5/1998 | Manley | 62/620 |
| 5,771,712 | A | 6/1998 | Campbell et al. | 62/621 |
| 5,799,507 | A | 9/1998 | Wilkinson et al. | 62/621 |
| 5,881,569 | A | 3/1999 | Campbell et al. | 62/621 |
| 5,890,378 | A | 4/1999 | Rambo et al. | 62/621 |
| 5,893,274 | A | 4/1999 | Nagelvoort et al. | 62/613 |
| 5,983,664 | A | 11/1999 | Campbell et al. | 62/621 |
| 6,014,869 | A | 1/2000 | Elion et al. | 62/621 |
| 6,023,942 | A | 2/2000 | Thomas et al. | 62/613 |
| 6,053,007 | A | 4/2000 | Victory et al. | 62/619 |
| 6,062,041 | A | 5/2000 | Kikkawa et al. | 62/613 |
| 6,116,050 | A | 9/2000 | Yao et al. | 62/630 |
| 6,119,479 | A | 9/2000 | Roberts et al. | 62/612 |
| 6,125,653 | A | 10/2000 | Shu et al. | 62/622 |
| 6,182,469 | B1 | 2/2001 | Campbell et al. | 62/621 |
| 6,250,105 | B1 | 6/2001 | Kimble | 62/613 |
| 6,269,655 | B1 | 8/2001 | Roberts et al. | 62/612 |
| 6,272,882 | B1 | 8/2001 | Hodges et al. | 62/613 |
| 6,308,531 | B1 | 10/2001 | Roberts et al. | 62/611 |
| 6,324,867 | B1 | 12/2001 | Fanning et al. | 62/613 |
| 6,336,344 | B1 | 1/2002 | O'Brien | 62/627 |
| 6,347,532 | B1 | 2/2002 | Agrawal et al. | 62/612 |
| 6,363,744 | B2 | 4/2002 | Finn et al. | 62/621 |
| 6,367,286 | B1 | 4/2002 | Price | 62/613 |
| 6,526,777 | B1 | 3/2003 | Campbell et al. | 62/621 |
| 6,712,880 | B2 | 3/2004 | Foglietta et al. | 95/184 |
| 6,742,358 | B2 | 6/2004 | Wilkinson et al. | 62/613 |
| 2002/0166336 | A1 | 11/2002 | Wilkinson et al. | 62/620 |
| 2003/0005722 | A1 * | 1/2003 | Wilkinson et al. | 62/613 |
| 2003/0158458 | A1 | 8/2003 | Prim | 585/800 |
| 2004/0079107 | A1 | 4/2004 | Wilkinson et al. | 62/611 |

OTHER PUBLICATIONS

Mowrey, "Efficient, High Recovery of Liquids from Natural Gas Utilizing a High Pressure Absorber", Proceedings of the Eighty-First Annual Convention of the Gas Processors Association, Dallas, Texas, Mar. 11-13, 2002.

Kikkawa, Yoshitsugi, Masaaki Ohishi, and Noriyoshi Nozawa, "Optimize the Power System of Baseload LNG Plant", Proceedings of the Eightieht Annual Convention of the Gas Processors Assoiciation, San Antonio, Texas, Mar. 12-14, 2001.

Finn, Adrian J., Grant L. Johnson, and Terry R. Tomilson, "LNG Technology for Offshore and Mid-Scale Plants", Proceedings of the Seventy-Ninth Annual Convention of the Gas Processors Association, pp. 429-450, Atlanta, Georgia, Mar. 13-15, 2000.

Price, Brian C., "LNG Production for Peak Shaving Operations", Proceedings of the Seventy-Eighth Annual Convention of the Gas Processors Association, pp. 273-280, Nashville, Tennessee, Mar. 1-3, 1999.

* cited by examiner

HYDROCARBON GAS PROCESSING

CROSS REFERENCE TO RELATED APPLICATIONS

This application is a continuation of International Patent Application No. PCT/US2004/004206 which claims priority to U.S. Provisional Patent Application No. 60/449,772.

BACKGROUND OF THE INVENTION

This invention relates to a process for the separation of a gas containing hydrocarbons. The applicants claim the benefits under Title 35, United States Code, Section 119(e) of prior U.S. Provisional Application No. 60/449,772 which was filed on Feb. 25, 2003.

Ethylene, ethane, propylene, propane and/or heavier hydrocarbons can be recovered from a variety of gases, such as natural gas, refinery gas, and synthetic gas streams obtained from other hydrocarbon materials such as coal, crude oil, naphtha, oil shale, tar sands, and lignite. Natural gas usually has a major proportion of methane and ethane, i.e., methane and ethane together comprise at least 50 mole percent of the gas. The gas also contains relatively lesser amounts of heavier hydrocarbons such as propane, butanes, pentanes and the like, as well as hydrogen, nitrogen, carbon dioxide and other gases.

The present invention is generally concerned with the recovery of ethylene, ethane, propylene, propane and heavier hydrocarbons from such gas streams. A typical analysis of a gas stream to be processed in accordance with this invention would be, in approximate mole percent, 80.8% methane, 9.4% ethane and other $C_2$ components, 4.7% propane and other $C_3$ components, 1.2% iso-butane, 2.1% normal butane, and 1.1% pentanes plus, with the balance made up of nitrogen and carbon dioxide. Sulfur containing gases are also sometimes present.

The historically cyclic fluctuations in the prices of both natural gas and its natural gas liquid (NGL) constituents have at times reduced the incremental value of ethane, ethylene, propane, propylene, and heavier components as liquid products. This has resulted in a demand for processes that can provide more efficient recoveries of these products, for processes that can provide efficient recoveries with lower capital investment, and for processes that can be easily adapted or adjusted to vary the recovery of a specific component over a broad range. Available processes for separating these materials include those based upon cooling and refrigeration of gas, oil absorption, and refrigerated oil absorption. Additionally, cryogenic processes have become popular because of the availability of economical equipment that produces power while simultaneously expanding and extracting heat from the gas being processed. Depending upon the pressure of the gas source, the richness (ethane, ethylene, and heavier hydrocarbons content) of the gas, and the desired end products, each of these processes or a combination thereof may be employed.

The cryogenic expansion process is now generally preferred for natural gas liquids recovery because it provides maximum simplicity with ease of startup, operating flexibility, good efficiency, safety, and good reliability. U.S. Pat. Nos. 3,292,380; 4,061,481; 4,140,504; 4,157,904; 4,171,964; 4,185,978; 4,251,249; 4,278,457; 4,519,824; 4,617,039; 4,687,499; 4,689,063; 4,690,702; 4,854,955; 4,869,740; 4,889,545; 5,275,005; 5,555,748; 5,568,737; 5,771,712; 5,799,507; 5,881,569; 5,890,378; 5,983,664; 6,182,469; reissue U.S. Pat. No. 33,408; and co-pending application Ser. No. 09/677,220 describe relevant processes (although the description of the present invention in some cases is based on different processing conditions than those described in the cited U.S. patents).

In a typical cryogenic expansion recovery process, a feed gas stream under pressure is cooled by heat exchange with other streams of the process and/or external sources of refrigeration such as a propane compression-refrigeration system. As the gas is cooled, liquids may be condensed and collected in one or more separators as high-pressure liquids containing some of the desired $C_2$+ components. Depending on the richness of the gas and the amount of liquids formed, the high-pressure liquids may be expanded to a lower pressure and fractionated. The vaporization occurring during expansion of the liquids results in further cooling of the stream. Under some conditions, pre-cooling the high pressure liquids prior to the expansion may be desirable in order to further lower the temperature resulting from the expansion. The expanded stream, comprising a mixture of liquid and vapor, is fractionated in a distillation (demethanizer or deethanizer) column. In the column, the expansion cooled stream(s) is (are) distilled to separate residual methane, nitrogen, and other volatile gases as overhead vapor from the desired $C_2$ components, $C_3$ components, and heavier hydrocarbon components as bottom liquid product, or to separate residual methane, $C_2$ components, nitrogen, and other volatile gases as overhead vapor from the desired $C_3$ components and heavier hydrocarbon components as bottom liquid product.

If the feed gas is not totally condensed (typically it is not), the vapor remaining from the partial condensation can be split into two streams. One portion of the vapor is passed through a work expansion machine or engine, or an expansion valve, to a lower pressure at which additional liquids are condensed as a result of further cooling of the stream. The pressure after expansion is essentially the same as the pressure at which the distillation column is operated. The combined vapor-liquid phases resulting from the expansion are supplied as feed to the column.

The remaining portion of the vapor is cooled to substantial condensation by heat exchange with other process streams, e.g., the cold fractionation tower overhead. Some or all of the high-pressure liquid may be combined with this vapor portion prior to cooling. The resulting cooled stream is then expanded through an appropriate expansion device, such as an expansion valve, to the pressure at which the demethanizer is operated. During expansion, a portion of the liquid will vaporize, resulting in cooling of the total stream. The flash expanded stream is then supplied as top feed to the demethanizer. Typically, the vapor portion of the expanded stream and the demethanizer overhead vapor combine in an upper separator section in the fractionation tower as residual methane product gas. Alternatively, the cooled and expanded stream may be supplied to a separator to provide vapor and liquid streams. The vapor is combined with the tower overhead and the liquid is supplied to the column as a top column feed.

In the ideal operation of such a separation process, the residue gas leaving the process will contain substantially all of the methane in the feed gas with essentially none of the heavier hydrocarbon components and the bottoms fraction leaving the demethanizer will contain substantially all of the heavier hydrocarbon components with essentially no methane or more volatile components. In practice, however, this ideal situation is not obtained because the conventional demethanizer is operated largely as a stripping column. The methane product of the process, therefore, typically comprises vapors leaving the top fractionation stage of the column, together with vapors not subjected to any rectification step. Considerable losses of $C_3$ and $C_4$+ components occur because the top liquid feed contains substantial quantities of these components and heavier hydrocarbon components, resulting in corresponding equilibrium quantities of $C_3$ components, $C_4$ components, and heavier hydrocarbon components in the vapors leaving the top fractionation stage of the demethanizer. The loss of these desirable components could be significantly reduced if the rising vapors could be brought into contact with a significant quantity of liquid (reflux) capable of absorbing the $C_3$ components, $C_4$ components, and heavier hydrocarbon components from the vapors.

In recent years, the preferred processes for hydrocarbon separation use an upper absorber section to provide additional rectification of the rising vapors. The source of the reflux stream for the upper rectification section is typically a recycled stream of residue gas supplied under pressure. The recycled residue gas stream is usually cooled to substantial condensation by heat exchange with other process streams, e.g., the cold fractionation tower overhead. The resulting substantially condensed stream is then expanded through an appropriate expansion device, such as an expansion valve, to the pressure at which the demethanizer is operated. During expansion, a portion of the liquid will usually vaporize, resulting in cooling of the total stream. The flash expanded stream is then supplied as top feed to the demethanizer. Typically, the vapor portion of the expanded stream and the demethanizer overhead vapor combine in an upper separator section in the fractionation tower as residual methane product gas. Alternatively, the cooled and expanded stream may be supplied to a separator to provide vapor and liquid streams, so that thereafter the vapor is combined with the tower overhead and the liquid is supplied to the column as a top column feed. Typical process schemes of this type are disclosed in U.S. Pat. Nos. 4,889,545; 5,568,737; and 5,881,569, and in Mowrey, E. Ross, "Efficient, High Recovery of Liquids from Natural Gas Utilizing a High Pressure Absorber", Proceedings of the Eighty-First Annual Convention of the Gas Processors Association, Dallas, Tex., Mar. 11–13, 2002. Unfortunately, these processes require the use of a compressor to provide the motive force for recycling the reflux stream to the demethanizer, adding to both the capital cost and the operating cost of facilities using these processes.

The present invention also employs an upper rectification section (or a separate rectification column in some embodiments). However, the reflux stream for this rectification section is provided by using a side draw of the vapors rising in a lower portion of the tower. Because of the relatively high concentration of $C_2$ components in the vapors lower in the tower, a significant quantity of liquid can be condensed in this side draw stream without elevating its pressure, often using only the refrigeration available in the cold vapor leaving the upper rectification section. This condensed liquid, which is predominantly liquid methane and ethane, can then be used to absorb $C_3$ components, $C_4$ components, and heavier hydrocarbon components from the vapors rising through the upper rectification section and thereby capture these valuable components in the bottom liquid product from the demethanizer.

Heretofore, such a side draw feature has been employed in $C_3$+ recovery systems, as illustrated in the assignee's U.S. Pat. No. 5,799,507. The process and apparatus of U.S. Pat. No. 5,799,507, however, is unsuitable for high ethane recovery. Surprisingly, applicants have found that by combining the side draw feature of the assignee's U.S. Pat. No. 5,799,507 invention with the split vapor feed invention of the assignee's U.S. Pat. No. 4,278,457, $C_3$+ recoveries may be improved without sacrificing $C_2$ component recovery levels or system efficiency.

In accordance with the present invention, it has been found that $C_3$ and $C_4$+ recoveries in excess of 99 percent can be obtained without the need for compression of the reflux stream for the demethanizer with no loss in $C_2$ component recovery. The present invention provides the further advantage of being able to maintain in excess of 99 percent recovery of the $C_3$ and $C_4$+ components as the recovery of $C_2$ components is adjusted from high to low values. In addition, the present invention makes possible essentially 100 percent separation of methane and lighter components from the $C_2$ components and heavier components at reduced energy requirements compared to the prior art while maintaining the same recovery levels. The present invention, although applicable at lower pressures and warmer temperatures, is particularly advantageous when processing feed gases in the range of 400 to 1500 psia [2,758 to 10,342 kPa(a)] or higher under conditions requiring NGL recovery column overhead temperatures of −50° F. [−46° C.] or colder.

For a better understanding of the present invention, reference is made to the following examples and drawings. Referring to the drawings:

FIGS. 1 and 2 are flow diagrams of prior art natural gas processing plants in accordance with U.S. Pat. No. 4,278,457;

In the following explanation of the above figures, tables are provided summarizing flow rates calculated for representative process conditions. In the tables appearing herein, the values for flow rates (in moles per hour) have been rounded to the nearest whole number for convenience. The total stream rates shown in the tables include all non-hydrocarbon components and hence are generally larger than the sum of the stream flow rates for the hydrocarbon components. Temperatures indicated are approximate values rounded to the nearest degree. It should also be noted that the process design calculations performed for the purpose of comparing the processes depicted in the figures are based on the assumption of no heat leak from (or to) the surroundings to (or from) the process. The quality of commercially available insulating materials makes this a very reasonable assumption and one that is typically made by those skilled in the art.

For convenience, process parameters are reported in both the traditional British units and in the units of the Systëme International d'Unitës (SI). The molar flow rates given in the tables may be interpreted as either pound moles per hour or kilogram moles per hour. The energy consumptions reported as horsepower (HP) and/or thousand British Thermal Units per hour (MBTU/Hr) correspond to the stated molar flow rates in pound moles per hour. The energy consumptions reported as kilowatts (kW) correspond to the stated molar flow rates in kilogram moles per hour.

DESCRIPTION OF THE PRIOR ART

Figure 1:
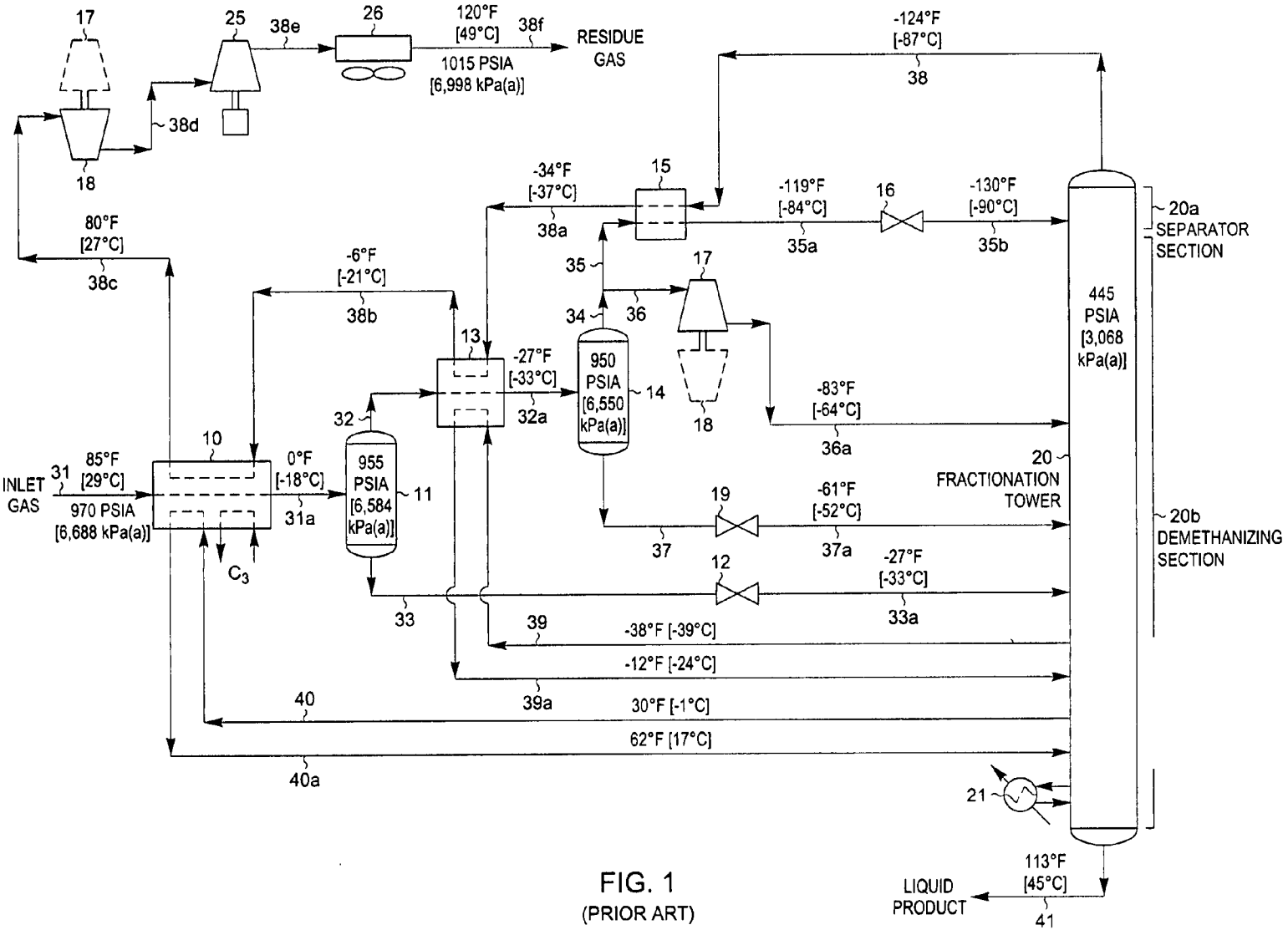
FIG. 1 (PRIOR ART)

FIG. 1 is a process flow diagram showing the design of a processing plant to recover $C_2$+ components from natural gas using prior art according to U.S. Pat. No. 4,278,457. In this simulation of the process, inlet gas enters the plant at 85° F. [29° C.] and 970 psia [6,688 kPa(a)] as stream 31. If the inlet gas contains a concentration of sulfur compounds which would prevent the product streams from meeting specifications, the sulfur compounds are removed by appropriate pretreatment of the feed gas (not illustrated). In addition, the feed stream is usually dehydrated to prevent hydrate (ice) formation under cryogenic conditions. Solid desiccant has typically been used for this purpose.

The feed stream 31 is cooled in heat exchanger 10 by heat exchange with cool residue gas at −6° F. [−21° C.] (stream 38*b*), demethanizer lower side reboiler liquids at 30° F. [−1° C.] (stream 40), and propane refrigerant. Note that in all cases exchanger 10 is representative of either a multitude of individual heat exchangers or a single multi-pass heat exchanger, or any combination thereof. (The decision as to whether to use more than one heat exchanger for the indicated cooling services will depend on a number of factors including, but not limited to, inlet gas flow rate, heat exchanger size, stream temperatures, etc.) The cooled stream 31*a* enters separator 11 at 0° F. [−18° C.] and 955 psia [6,584 kPa(a)] where the vapor (stream 32) is separated from the condensed liquid (stream 33). The separator liquid (stream 33) is expanded to the operating pressure (approximately 445 psia [3,068 kPa(a)]) of fractionation tower 20 by expansion valve 12, cooling stream 33*a* to −27° F. [−33° C.] before it is supplied to fractionation tower 20 at a lower mid-column feed point.

The separator vapor (stream 32) is further cooled in heat exchanger 13 by heat exchange with cool residue gas at −34° F. [−37° C.] (stream 38*a*) and demethanizer upper side reboiler liquids at −38° F. [−39° C.] (stream 39). The cooled stream 32*a* enters separator 14 at −27° F. [−33° C.] and 950 psia [6,550 kPa(a)] where the vapor (stream 34) is separated from the condensed liquid (stream 37). The separator liquid (stream 37) is expanded to the tower operating pressure by expansion valve 19, cooling stream 37*a* to −61° F. [−52° C.] before it is supplied to fractionation tower 20 at a second lower mid-column feed point.

The vapor (stream 34) from separator 14 is divided into two streams, 35 and 36. Stream 35, containing about 38% of the total vapor, passes through heat exchanger 15 in heat exchange relation with the cold residue gas at −124° F. [−87° C.] (stream 38) where it is cooled to substantial condensation. The resulting substantially condensed stream 35*a* at −119° F. [−84° C.] is then flash expanded through expansion valve 16 to the operating pressure of fractionation tower 20. During expansion a portion of the stream is vaporized, resulting in cooling of the total stream. In the process illustrated in FIG. 1, the expanded stream 35*b* leaving expansion valve 16 reaches a temperature of −130° F. [−90° C.] and is supplied to separator section 20*a* in the upper region of fractionation tower 20. The liquids separated therein become the top feed to demethanizing section 20*b*.

The remaining 62% of the vapor from separator 14 (stream 36) enters a work expansion machine 17 in which mechanical energy is extracted from this portion of the high pressure feed. The machine 17 expands the vapor substantially isentropically to the tower operating pressure, with the work expansion cooling the expanded stream 36*a* to a temperature of approximately −83° F. [−64° C.]. The typical commercially available expanders are capable of recovering on the order of 80–85% of the work theoretically available in an ideal isentropic expansion. The work recovered is often used to drive a centrifugal compressor (such as item 18) that can be used to re-compress the residue gas (stream 38*c*), for example. The partially condensed expanded stream 36*a* is thereafter supplied as feed to fractionation tower 20 at an upper mid-column feed point.

The demethanizer in tower 20 is a conventional distillation column containing a plurality of vertically spaced trays, one or more packed beds, or some combination of trays and packing. As is often the case in natural gas processing plants, the fractionation tower may consist of two sections. The upper section 20*a* is a separator wherein the partially vaporized top feed is divided into its respective vapor and liquid portions, and wherein the vapor rising from the lower distillation or demethanizing section 20*b* is combined with the vapor portion of the top feed to form the cold demethanizer overhead vapor (stream 38) which exits the top of the tower at −124° F. [−87° C.]. The lower, demethanizing section 20*b* contains the trays and/or packing and provides the necessary contact between the liquids falling downward and the vapors rising upward. The demethanizing section 20*b* also includes reboilers (such as reboiler 21 and the side reboilers described previously) which heat and vaporize a portion of the liquids flowing down the column to provide the stripping vapors which flow up the column to strip the liquid product, stream 41, of methane and lighter components.

The liquid product stream 41 exits the bottom of the tower at 113° F. [45° C.], based on a typical specification of a methane to ethane ratio of 0.025:1 on a molar basis in the bottom product. The residue gas (demethanizer overhead vapor stream 38) passes countercurrently to the incoming feed gas in heat exchanger 15 where it is heated to −34° F. [−37° C.] (stream 38*a*), in heat exchanger 13 where it is heated to −6° F. [−21° C.] (stream 38*b*), and in heat exchanger 10 where it is heated to 80° F. [27° C.] (stream 38*c*). The residue gas is then re-compressed in two stages. The first stage is compressor 18 driven by expansion machine 17. The second stage is compressor 25 driven by a supplemental power source which compresses the residue gas (stream 38*d*) to sales line pressure. After cooling to 120° F. [49° C.] in discharge cooler 26, the residue gas product (stream 38*f*) flows to the sales gas pipeline at 1015 psia [6,998 kPa(a)], sufficient to meet line requirements (usually on the order of the inlet pressure).

A summary of stream flow rates and energy consumption for the process illustrated in FIG. 1 is set forth in the following table:

TABLE I (FIG. 1)
Stream Flow Summary - Lb. Moles/Hr [kg moles/Hr]

| Stream | Methane | Ethane | Propane | Butanes+ | Total |
|---|---|---|---|---|---|
| 31 | 53,228 | 6,192 | 3,070 | 2,912 | 65,876 |
| 32 | 49,244 | 4,670 | 1,650 | 815 | 56,795 |
| 33 | 3,984 | 1,522 | 1,420 | 2,097 | 9,081 |
| 34 | 47,675 | 4,148 | 1,246 | 445 | 53,908 |
| 37 | 1,569 | 522 | 404 | 370 | 2,887 |
| 35 | 18,117 | 1,576 | 473 | 169 | 20,485 |
| 36 | 29,558 | 2,572 | 773 | 276 | 33,423 |
| 38 | 53,098 | 978 | 44 | 4 | 54,460 |
| 41 | 130 | 5,214 | 3,026 | 2,908 | 11,416 |

TABLE I-continued (FIG. 1)
Stream Flow Summary - Lb. Moles/Hr [kg moles/Hr]

| Stream | Methane | Ethane | Propane | Butanes+ | Total |
|---|---|---|---|---|---|
| | | Recoveries* | | | |
| Ethane | | 84.21% | | | |
| Propane | | 98.58% | | | |
| Butanes+ | | 99.88% | | | |
| | | Power | | | |
| Residue Gas Compression | | 23,628 HP | | [38,844 kW] | |
| | | Utility Cooling | | | |
| Propane Refrigeration Duty | | 37,455 MBTU/H | | [24,194 kW] | |

*(Based on un-rounded flow rates)

Figure 2:
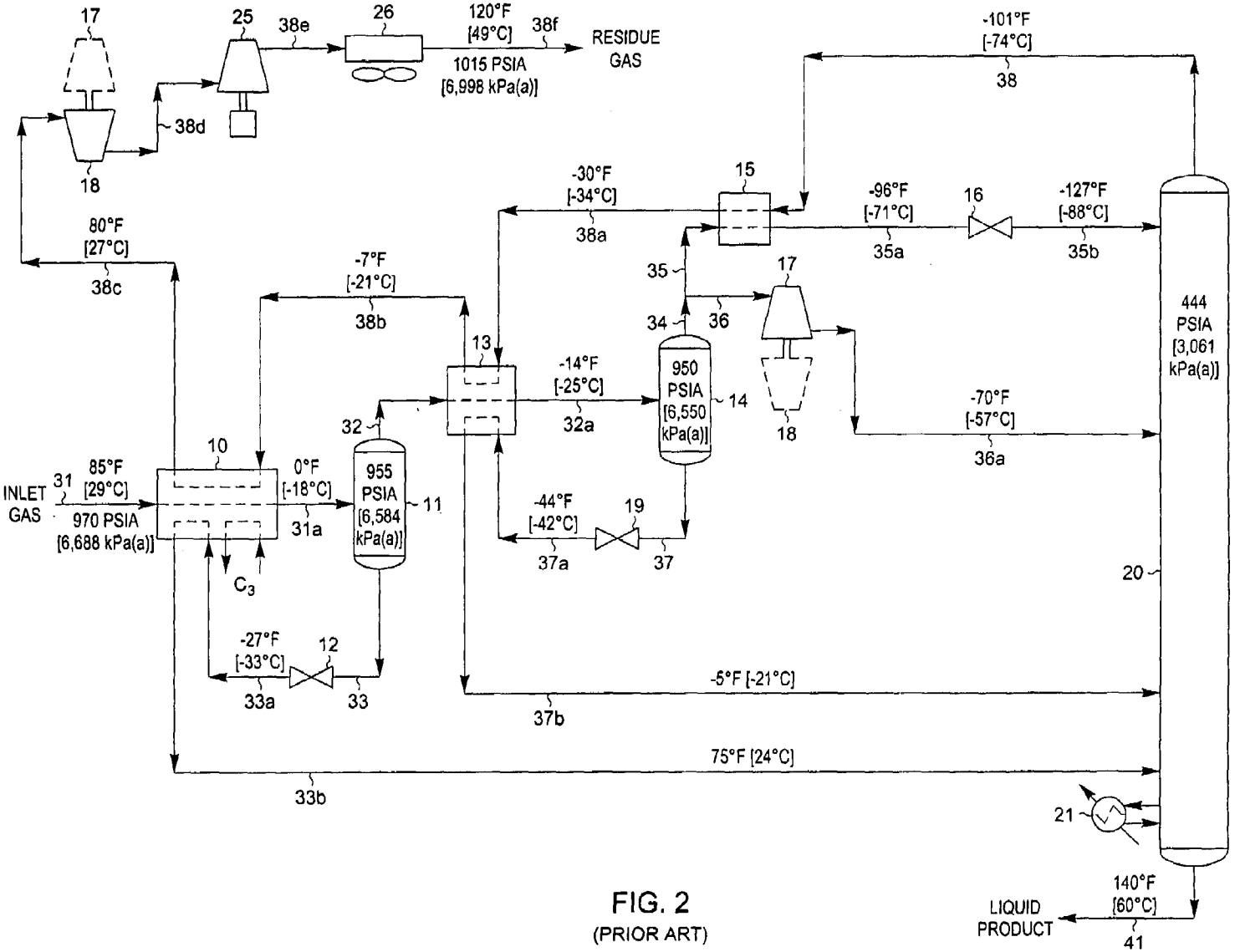
FIG. 2 (PRIOR ART)

FIG. 2 is a process flow diagram showing one manner in which the design of the processing plant in FIG. 1 can be adapted to operate at a lower $C_2$ component recovery level. This is a common requirement when the $C_2$ components recovered in the processing plant are dedicated to a downstream chemical plant that has a limited capacity. The process of FIG. 2 has been applied to the same feed gas composition and conditions as described previously for FIG. 1. However, in the simulation of the process of FIG. 2 the process operating conditions have been adjusted to reduce the recovery of $C_2$ components to about 50%.

In the simulation of the FIG. 2 process, the inlet gas cooling, separation, and expansion scheme for the processing plant is much the same as that used in FIG. 1. The main difference is that the flash expanded separator liquid streams (streams 33*a* and 37*a*) are used to provide feed gas cooling, instead of using side reboiler liquids from fractionation tower 20 as shown in FIG. 1. Due to the lower recovery of $C_2$ components in the tower bottom liquid (stream 41), the temperatures in fractionation tower 20 are higher, making the tower liquids too warm for effective heat exchange with the feed gas.

The feed stream 31 is cooled in heat exchanger 10 by heat exchange with cool residue gas at −7° F. [−21° C.] (stream 38*b*), flash expanded liquids (stream 33*a*), and propane refrigerant. The cooled stream 31*a* enters separator 11 at 0° F. [−18° C.] and 955 psia [6,584 kPa(a)] where the vapor (stream 32) is separated from the condensed liquid (stream 33). The separator liquid (stream 33) is expanded to slightly above the operating pressure (approximately 444 psia [3,061 kPa(a)]) of fractionation tower 20 by expansion valve 12, cooling stream 33*a* to −27° F. [−33° C.] before it enters heat exchanger 10 and is heated as it provides cooling of the incoming feed gas as described earlier. The expanded liquid stream is heated to 75° F. [24° C.], partially vaporizing stream 33*b* before it is supplied to fractionation tower 20 at a lower mid-column feed point.

The separator vapor (stream 32) is further cooled in heat exchanger 13 by heat exchange with cool residue gas at −30° F. [−34° C.] (stream 38*a*) and flash expanded liquids (stream 37*a*). The cooled stream 32*a* enters separator 14 at −14° F. [−25° C.] and 950 psia [6,550 kPa(a)] where the vapor (stream 34) is separated from the condensed liquid (stream 37). The separator liquid (stream 37) is expanded to slightly above the operating pressure of fractionation tower 20 by expansion valve 19, cooling stream 37*a* to −44° F. [−42° C.] before it enters heat exchanger 13 and is heated as it provides cooling of stream 32 as described earlier. The expanded liquid stream is heated to −5° F. [−21° C.], partially vaporizing stream 37*b* before it is supplied to fractionation tower 20 at a second lower mid-column feed point.

The vapor (stream 34) from separator 14 is divided into two streams, 35 and 36. Stream 35, containing about 32% of the total vapor, passes through heat exchanger 15 in heat exchange relation with the cold residue gas at −101° F. [−74° C.] (stream 38) where it is cooled to substantial condensation. The resulting substantially condensed stream 35*a* at −96° F. [−71° C.] is then flash expanded through expansion valve 16 to the operating pressure of fractionation tower 20. During expansion a portion of the stream is vaporized, resulting in cooling of the total stream. In the process illustrated in FIG. 2, the expanded stream 35*b* leaving expansion valve 16 reaches a temperature of −127° F. [−88° C.] and is supplied to fractionation tower 20 as the top feed.

The remaining 68% of the vapor from separator 14 (stream 36) enters a work expansion machine 17 in which mechanical energy is extracted from this portion of the high pressure feed. The machine 17 expands the vapor substantially isentropically to the tower operating pressure, with the work expansion cooling the expanded stream 36*a* to a temperature of approximately −70° F. [−57° C.]. The partially condensed expanded stream 36*a* is thereafter supplied as feed to fractionation tower 20 an upper mid-column feed point.

The liquid product stream 41 exits the bottom of the tower at 140° F. [60° C.]. The residue gas (demethanizer overhead vapor stream 38) passes countercurrently to the incoming feed gas in heat exchanger 15 where it is heated to −30° F. [−34° C.] (stream 38*a*), in heat exchanger 13 where it is heated to −7° F. [−21° C.] (stream 38*b*), and in heat exchanger 10 where it is heated to 80° F. [27° C.] (stream 38*c*). The residue gas is then re-compressed in two stages, compressor 18 driven by expansion machine 17 and compressor 25 driven by a supplemental power source. After stream 38*e* is cooled to 120° F. [49° C.] in discharge cooler 26, the residue gas product (stream 38*f*) flows to the sales gas pipeline at 1015 psia [6,998 kPa(a)].

A summary of stream flow rates and energy consumption for the process illustrated in FIG. 2 is set forth in the following table:

TABLE II (FIG. 2)
Stream Flow Summary - Lb. Moles/Hr [kg moles/Hr]

| Stream | Methane | Ethane | Propane | Butanes+ | Total |
|---|---|---|---|---|---|
| 31 | 53,228 | 6,192 | 3,070 | 2,912 | 65,876 |
| 32 | 49,244 | 4,670 | 1,650 | 815 | 56,795 |
| 33 | 3,984 | 1,522 | 1,420 | 2,097 | 9,081 |
| 34 | 48,691 | 4,470 | 1,476 | 618 | 55,663 |
| 37 | 553 | 200 | 174 | 197 | 1,132 |
| 35 | 15,825 | 1,453 | 480 | 201 | 18,090 |
| 36 | 32,866 | 3,017 | 996 | 417 | 37,573 |
| 38 | 53,149 | 3,041 | 107 | 9 | 56,757 |
| 41 | 79 | 3,151 | 2,963 | 2,903 | 9,119 |
| | | Recoveries* | | | |
| Ethane | | 50.89% | | | |
| Propane | | 96.51% | | | |
| Butanes+ | | 99.68% | | | |
| | | Power | | | |
| Residue Gas Compression | | 23,773 HP | | [39,082 kW] | |
| | | Utility Cooling | | | |
| Propane Refrigeration Duty | | 29,436 MBTU/H | | [19,014 kW] | |

*(Based on un-rounded flow rates)

DESCRIPTION OF THE INVENTION

EXAMPLE 1

Figure 3:
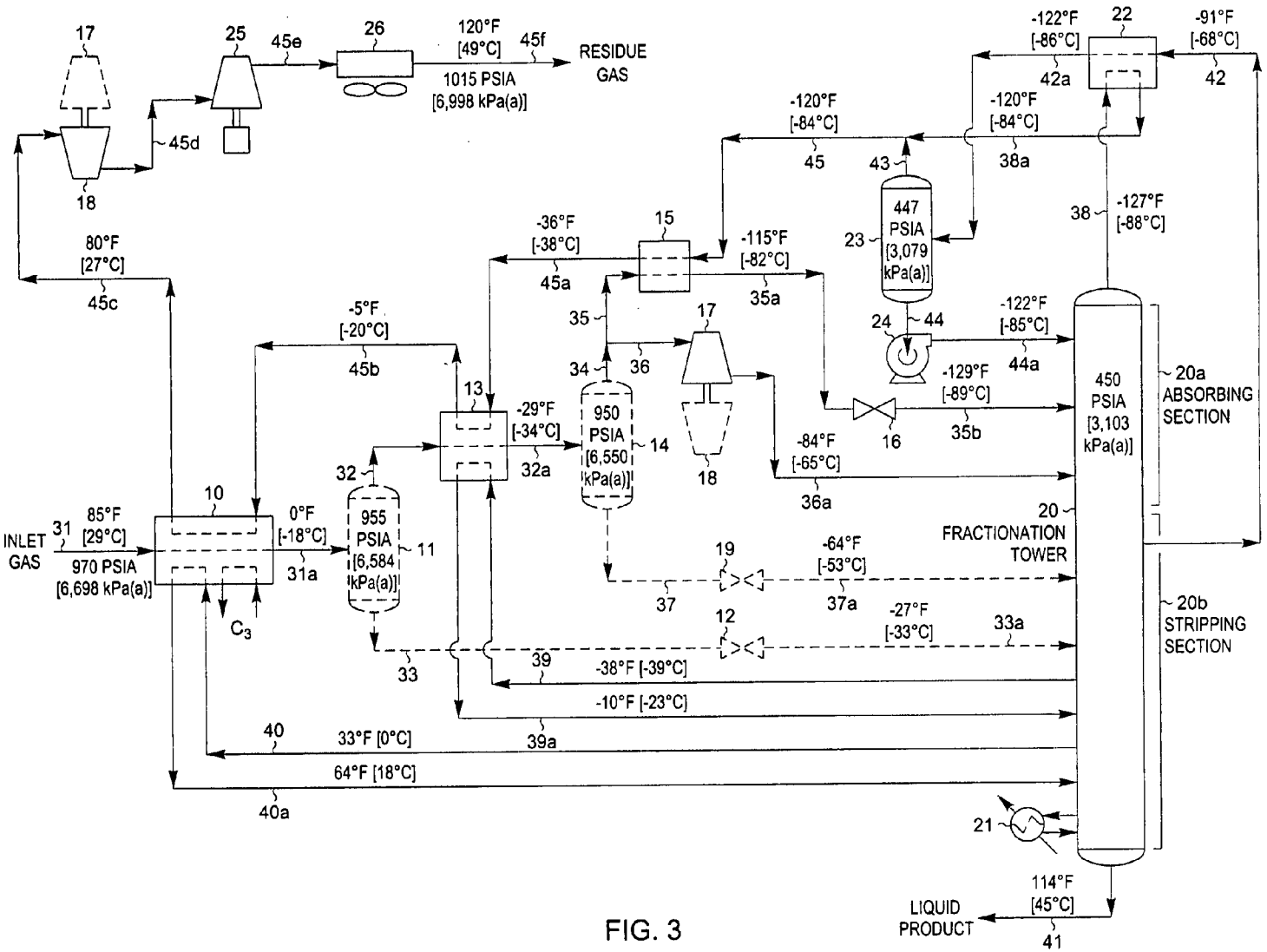
FIGS. 3 and 4 are flow diagrams of natural gas processing plants in accordance with the present invention.

FIG. 3 illustrates a flow diagram of a process in accordance with the present invention. The feed gas composition and conditions considered in the process presented in FIG. 3 are the same as those in FIG. 1. Accordingly, the FIG. 3 process can be compared with that of the FIG. 1 process to illustrate the advantages of the present invention.

In the simulation of the FIG. 3 process, inlet gas enters the plant as stream 31 and is cooled in heat exchanger 10 by heat exchange with cool residue gas at −5° F. [−20° C.] (stream 45*b*), demethanizer lower side reboiler liquids at 33° F. [0° C.] (stream 40), and propane refrigerant. The cooled stream 31*a* enters separator 11 at 0° F. [−18° C.] and 955 psia [6,584 kPa(a)] where the vapor (stream 32) is separated from the condensed liquid (stream 33). The separator liquid (stream 33) is expanded to the operating pressure (approximately 450 psia [3,103 kPa(a)]) of fractionation tower 20 by expansion valve 12, cooling stream 33*a* to −27° F. [−33° C.] before it is supplied to fractionation tower 20 at a lower mid-column feed point.

The separator vapor (stream 32) is further cooled in heat exchanger 13 by heat exchange with cool residue gas at −36° F. [−38° C.] (stream 45*a*) and demethanizer upper side reboiler liquids at −38° F. [−39° C.] (stream 39). The cooled stream 32*a* enters separator 14 at −29° F. [−34° C.] and 950 psia [6,550 kPa(a)] where the vapor (stream 34) is separated from the condensed liquid (stream 37). The separator liquid (stream 37) is expanded to the tower operating pressure by expansion valve 19, cooling stream 37*a* to −64° F. [−53° C.] before it is supplied to fractionation tower 20 at a second lower mid-column feed point.

The vapor (stream 34) from separator 14 is divided into two streams, 35 and 36. Stream 35, containing about 37% of the total vapor, passes through heat exchanger 15 in heat exchange relation with the cold residue gas at −120° F. [−84° C.] (stream 45) where it is cooled to substantial condensation. The resulting substantially condensed stream 35*a* at −115° F. [−82° C.] is then flash expanded through expansion valve 16 to the operating pressure of fractionation tower 20. During expansion a portion of the stream is vaporized, resulting in cooling of the total stream. In the process illustrated in FIG. 3, the expanded stream 35*b* leaving expansion valve 16 reaches a temperature of −129° F. [−89° C.] and is supplied to fractionation tower 20 at an upper mid-column feed point.

The remaining 63% of the vapor from separator 14 (stream 36) enters a work expansion machine 17 in which mechanical energy is extracted from this portion of the high pressure feed. The machine 17 expands the vapor substantially isentropically to the tower operating pressure, with the work expansion cooling the expanded stream 36*a* to a temperature of approximately −84° F. [−65° C.]. The partially condensed expanded stream 36*a* is thereafter supplied as feed to fractionation tower 20 a lower mid-column feed point.

The demethanizer in tower 20 is a conventional distillation column containing a plurality of vertically spaced trays, one or more packed beds, or some combination of trays and packing. The demethanizer tower consists of two sections: an upper absorbing (rectification) section 20*a* that contains the trays and/or packing to provide the necessary contact between the vapor portion of the expanded streams 35*b* and 36*a* rising upward and cold liquid falling downward to condense and absorb the ethane, propane, and heavier components; and a lower, stripping section 20*b* that contains the trays and/or packing to provide the necessary contact between the liquids falling downward and the vapors rising upward. The demethanizing section 20*b* also includes reboilers (such as reboiler 21 and the side reboilers described previously) which heat and vaporize a portion of the liquids flowing down the column to provide the stripping vapors which flow up the column to strip the liquid product, stream 41, of methane and lighter components. Stream 36*a* enters demethanizer 20 at an intermediate feed position located in the lower region of absorbing section 20*a* of demethanizer 20. The liquid portion of the expanded stream commingles with liquids falling downward from the absorbing section 20*a* and the combined liquid continues downward into the stripping section 20*b* of demethanizer 20. The vapor portion of the expanded stream rises upward through absorbing section 20*a* and is contacted with cold liquid falling downward to condense and absorb the ethane, propane, and heavier components.

A portion of the distillation vapor (stream 42) is withdrawn from the upper region of stripping section 20*b*. This stream is then cooled from −91° F. [−68° C.] to −122° F. [−86° C.] and partially condensed (stream 42*a*) in heat exchanger 22 by heat exchange with the cold demethanizer overhead stream 38 exiting the top of demethanizer 20 at −127° F. [−88° C.]. The cold demethanizer overhead stream is warmed slightly to −120° F. [−84° C.] (stream 38*a*) as it cools and condenses at least a portion of stream 42.

The operating pressure in reflux separator 23 (447 psia [3,079 kPa(a)]) is maintained slightly below the operating pressure of demethanizer 20. This provides the driving force which causes distillation vapor stream 42 to flow through heat exchanger 22 and thence into the reflux separator 23 wherein the condensed liquid (stream 44) is separated from any uncondensed vapor (stream 43). Stream 43 then combines with the warmed demethanizer overhead stream 38*a* from heat exchanger 22 to form cold residue gas stream 45 at −120° F. [−84° C.].

The liquid stream 44 from reflux separator 23 is pumped by pump 24 to a pressure slightly above the operating pressure of demethanizer 20, and stream 44*a* is then supplied as cold top column feed (reflux) to demethanizer 20. This cold liquid reflux absorbs and condenses the propane and heavier components rising in the upper rectification region of absorbing section 20*a* of demethanizer 20.

In stripping section 20*b* of demethanizer 20; the feed streams are stripped of their methane and lighter components. The resulting liquid product (stream 41) exits the bottom of tower 20 at 114° F. [45° C.]. The distillation vapor stream forming the tower overhead (stream 38) is warmed in heat exchanger 22 as it provides cooling to distillation stream 42 as described previously, then combines with stream 43 to form the cold residue gas stream 45. The residue gas passes countercurrently to the incoming feed gas in heat exchanger 15 where it is heated to −36° F. [−38° C.] (stream 45*a*), in heat exchanger 13 where it is heated to −5° F. [−20° C.] (stream 45*b*), and in heat exchanger 10 where it is heated to 80° F. [27° C.] (stream 45*c*) as it provides cooling as previously described. The residue gas is then re-compressed in two stages, compressor 18 driven by expansion machine 17 and compressor 25 driven by a supplemental power source. After stream 45*e* is cooled to 120° F. [49° C.] in discharge cooler 26, the residue gas product (stream 45*f*) flows to the sales gas pipeline at 1015 psia [6,998 kPa(a)].

A summary of stream flow rates and energy consumption for the process illustrated in FIG. 3 is set forth in the following table:

TABLE III (FIG. 3)
Stream Flow Summary - Lb. Moles/Hr [kg moles/Hr]

| Stream | Methane | Ethane | Propane | Butanes+ | Total |
|---|---|---|---|---|---|
| 31 | 53,228 | 6,192 | 3,070 | 2,912 | 65,876 |
| 32 | 49,244 | 4,670 | 1,650 | 815 | 56,795 |
| 33 | 3,984 | 1,522 | 1,420 | 2,097 | 9,081 |
| 34 | 47,440 | 4,081 | 1,204 | 420 | 53,536 |
| 37 | 1,804 | 589 | 446 | 395 | 3,259 |
| 35 | 17,553 | 1,510 | 445 | 155 | 19,808 |
| 36 | 29,887 | 2,571 | 759 | 265 | 33,728 |
| 38 | 48,673 | 811 | 23 | 1 | 49,803 |
| 42 | 5,555 | 373 | 22 | 2 | 6,000 |
| 43 | 4,423 | 113 | 2 | 0 | 4,564 |
| 44 | 1,132 | 260 | 20 | 2 | 1,436 |
| 45 | 53,096 | 924 | 25 | 1 | 54,367 |
| 41 | 132 | 5,268 | 3,045 | 2,911 | 11,509 |

| Recoveries* | | |
|---|---|---|
| Ethane | 85.08% | |
| Propane | 99.20% | |
| Butanes+ | 99.98% | |
| **Power** | | |
| Residue Gas Compression | 23,630 HP | [38,847 kW] |
| **Utility Cooling** | | |
| Propane Refrigeration Duty | 37,581 MBTU/H | [24,275 kW] |

*(Based on un-rounded flow rates)

A comparison of Tables I and III shows that, compared to the prior art, the present invention improves ethane recovery from 84.21% to 85.08%, propane recovery from 98.58% to 99.20%, and butanes+ recovery from 99.88% to 99.98%. Comparison of Tables I and III further shows that the improvement in yields was achieved using essentially the same horsepower and utility requirements.

The improvement in recoveries provided by the present invention is due to the supplemental rectification provided by reflux stream 44*a*, which reduces the amount of propane and $C_4$+ components contained in the inlet feed gas that is lost to the residue gas. Although the expanded substantially condensed feed stream 35*b* supplied to absorbing section 20*a* of demethanizer 20 provides bulk recovery of the ethane, propane, and heavier hydrocarbon components contained in expanded feed 36*a* and the vapors rising from stripping section 20*b*, it cannot capture all of the propane and heavier hydrocarbon components due to equilibrium effects because stream 35*b* itself contains propane and heavier hydrocarbon components. However, reflux stream 44*a* of the present invention is predominantly liquid methane and ethane and contains very little propane and heavier hydrocarbon components, so that only a small quantity of reflux to the upper rectification section in absorbing section 20*a* is sufficient to capture nearly all of the propane and heavier hydrocarbon components. As a result, nearly 100% of the propane and substantially all of the heavier hydrocarbon components are recovered in liquid product 41 leaving the bottom of demethanizer 20. Due to the bulk liquid recovery provided by expanded substantially condensed feed stream 35*b*, the quantity of reflux (stream 44*a*) needed is small enough that the cold demethanizer overhead vapor (stream 38) can provide the refrigeration to generate this reflux without significantly impacting the cooling of feed stream 35 in heat exchanger 15.

EXAMPLE 2

Figure 4:
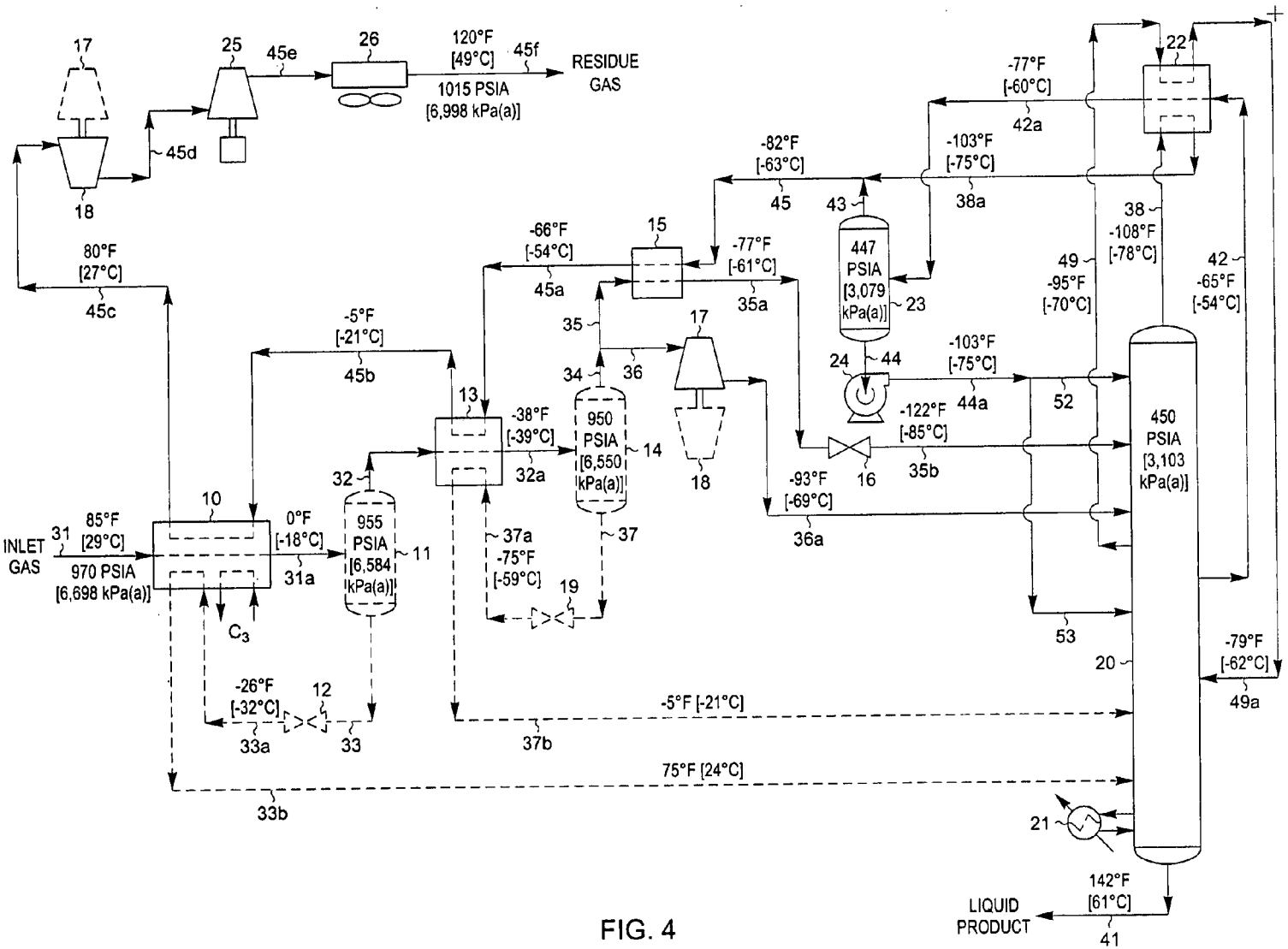

In those cases where the $C_2$ component recovery level in the liquid product must be reduced (as in the FIG. 2 prior art process described previously, for instance), the present invention offers very significant recovery and efficiency advantages over the prior art process depicted in FIG. 2. The operating conditions of the FIG. 3 process can be altered as illustrated in FIG. 4 to reduce the ethane content in the liquid product of the present invention to the same level as for the FIG. 2 prior art process. The feed gas composition and conditions considered in the process presented in FIG. 4 are the same as those in FIG. 2. Accordingly, the FIG. 4 process can be compared with that of the FIG. 2 process to further illustrate the advantages of the present invention.

In the simulation of the FIG. 4 process, the inlet gas cooling, separation, and expansion scheme for the processing plant is much the same as that used in FIG. 3. The main difference is that the flash expanded separator liquid streams (streams 33*a* and 37*a*) are used to provide feed gas cooling, instead of using side reboiler liquids from fractionation tower 20 as shown in FIG. 3. Due to the lower recovery of $C_2$ components in the tower bottom liquid (stream 41), the temperatures in fractionation tower 20 are higher, making the tower liquids too warm for effective heat exchange with the feed gas. An additional difference is that a side draw of tower liquids (stream 49) is used to supplement the cooling provided in heat exchanger 22 by tower overhead vapor stream 38.

The feed stream 31 is cooled in heat exchanger 10 by heat exchange with cool residue gas at −5° F. [−21° C.] (stream 45*b*), flash expanded liquids (stream 33*a*), and propane refrigerant. The cooled stream 31*a* enters separator 11 at 0° F. [−18° C.] and 955 psia [6,584 kPa(a)] where the vapor (stream 32) is separated from the condensed liquid (stream 33). The separator liquid (stream 33) is expanded to slightly above the operating pressure (approximately 450 psia [3,103 kPa(a)]) of fractionation tower 20 by expansion valve 12, cooling stream 33*a* to −26° F. [−32° C.] before it enters heat exchanger 10 and is heated as it provides cooling of the incoming feed gas as described earlier. The expanded liquid stream is heated to 75° F. [24° C.], partially vaporizing stream 33*b* before it is supplied to fractionation tower 20 at a lower mid-column feed point.

The separator vapor (stream 32) is further cooled in heat exchanger 13 by heat exchange with cool residue gas at −66° F. [−54° C.] (stream 45*a*) and flash expanded liquids (stream 37*a*). The cooled stream 32*a* enters separator 14 at −38° F. [−39° C.] and 950 psia [6,550 kPa(a)] where the vapor (stream 34) is separated from the condensed liquid (stream 37). The separator liquid (stream 37) is expanded to slightly above the operating pressure of fractionation tower 20 by expansion valve 19, cooling stream 37*a* to −75° F. [−59° C.] before it enters heat exchanger 13 and is heated as it provides cooling of stream 32 as described earlier. The expanded liquid stream is heated to −5° F. [−21° C.], partially vaporizing stream 37*b* before it is supplied to fractionation tower 20 at a second lower mid-column feed point.

The vapor (stream 34) from separator 14 is divided into two streams, 35 and 36. Stream 35, containing about 15% of the total vapor, passes through heat exchanger 15 in heat exchange relation with the cold residue gas at −82° F. [−63° C.] (stream 45) where it is cooled to substantial condensation. The resulting substantially condensed stream 35*a* at −77° F. [−61° C.] is then flash expanded through expansion valve 16 to the operating pressure of fractionation tower 20.

During expansion a portion of the stream is vaporized, resulting in cooling of the total stream. In the process illustrated in FIG. 4, the expanded stream 35*b* leaving expansion valve 16 reaches a temperature of −122° F. [−85° C.] and is supplied to fractionation tower 20 at an upper mid-column feed point.

The remaining 85% of the vapor from separator 14 (stream 36) enters a work expansion machine 17 in which mechanical energy is extracted from this portion of the high pressure feed. The machine 17 expands the vapor substantially isentropically to the tower operating pressure, with the work expansion cooling the expanded stream 36*a* to a temperature of approximately −93° F. [−69° C.]. The partially condensed expanded stream 36*a* is thereafter supplied as feed to fractionation tower 20 a lower mid-column feed point.

A portion of the distillation vapor (stream 42) is withdrawn from the upper region of the stripping section in fractionation tower 20. This stream is then cooled from −65° F. [−54° C.] to −77° F. [−60° C.] and partially condensed (stream 42*a*) in heat exchanger 22 by heat exchange with the cold demethanizer overhead stream 38 exiting the top of demethanizer 20 at −108° F. [−78° C.] and demethanizer liquid stream 49 at −95° F. [−70° C.] withdrawn from the lower region of the absorbing section in fractionation tower 20. The cold demethanizer overhead stream is warmed slightly to −103° F. [−75° C.] (stream 38*a*) and the demethanizer liquid stream is heated to −79° F. [−62° C.] (stream 49*a*) as they cool and condense at least a portion of stream 42. The heated and partially vaporized stream 49*a* is returned to the middle region of the stripping section in demethanizer 20.

The operating pressure in reflux separator 23 (447 psia [3,079 kPa(a)]) is maintained slightly below the operating pressure of demethanizer 20. This pressure differential allows distillation vapor stream 42 to flow through heat exchanger 22 and thence into the reflux separator 23 wherein the condensed liquid (stream 44) is separated from any uncondensed vapor (stream 43). Stream 43 then combines with the warmed demethanizer overhead stream 38*a* from heat exchanger 22 to form cold residue gas stream 45 at −82° F. [−63° C.].

The liquid stream 44 from reflux separator 23 is pumped by pump 24 to a pressure slightly above the operating pressure of demethanizer 20. The pumped stream 44*a* is then divided into at least two portions, streams 52 and 53. One portion, stream 52 containing about 50% of the total, is supplied as cold top column feed (reflux) to the absorbing section in demethanizer 20. This cold liquid reflux absorbs and condenses the propane and heavier components rising in the upper rectification region of the absorbing section of demethanizer 20. The other portion, stream 53, is supplied to demethanizer 20 at a mid-column feed position located in the upper region of the stripping section, in substantially the same region where distillation vapor stream 42 is withdrawn, to provide partial rectification of stream 42.

The liquid product stream 41 exits the bottom of the tower at 142° F. [61° C.]. The distillation vapor stream forming the tower overhead (stream 38) is warmed in heat exchanger 22 as it provides cooling to distillation stream 42 as described previously, then combines with stream 43 to form the cold residue gas stream 45. The residue gas passes countercurrently to the incoming feed gas in heat exchanger 15 where it is heated to −66° F. [−54° C.] (stream 45*a*), in heat exchanger 13 where it is heated to −5° F. [−21° C.] (stream 45*b*), and in heat exchanger 10 where it is heated to 80° F. [27° C.] (stream 45*c*) as it provides cooling as previously described. The residue gas is then re-compressed in two stages, compressor 18 driven by expansion machine 17 and compressor 25 driven by a supplemental power source. After stream 45*e* is cooled to 120° F. [49° C.] in discharge cooler 26, the residue gas product (stream 45*f*) flows to the sales gas pipeline at 1015 psia [6,998 kPa(a)].

A summary of stream flow rates and energy consumption for the process illustrated in FIG. 4 is set forth in the following table:

TABLE IV (FIG. 4)
Stream Flow Summary - Lb. Moles/Hr [kg moles/Hr]

| Stream | Methane | Ethane | Propane | Butanes+ | Total |
|---|---|---|---|---|---|
| 31 | 53,228 | 6,192 | 3,070 | 2,912 | 65,876 |
| 32 | 49,244 | 4,670 | 1,650 | 815 | 56,795 |
| 33 | 3,984 | 1,522 | 1,420 | 2,097 | 9,081 |
| 34 | 46,206 | 3,769 | 1,035 | 333 | 51,718 |
| 37 | 3,038 | 901 | 615 | 482 | 5,077 |
| 35 | 6,931 | 565 | 155 | 50 | 7,758 |
| 36 | 39,275 | 3,204 | 880 | 283 | 43,960 |
| 38 | 43,720 | 2,409 | 6 | 0 | 46,484 |
| 49 | 4,146 | 2,363 | 1,034 | 332 | 7,962 |
| 42 | 12,721 | 2,638 | 13 | 0 | 15,589 |
| 43 | 9,429 | 631 | 1 | 0 | 10,161 |
| 44 | 3,292 | 2,007 | 12 | 0 | 5,428 |
| 45 | 53,149 | 3,040 | 7 | 0 | 56,645 |
| 41 | 79 | 3,152 | 3,063 | 2,912 | 9,231 |

Recoveries*

| | |
|---|---|
| Ethane | 50.89% |
| Propane | 99.78% |
| Butanes+ | 100.00% |

Power

| | | |
|---|---|---|
| Residue Gas Compression | 23,726 HP | [39,005 kW] |

Utility Cooling

| | | |
|---|---|---|
| Propane Refrigeration Duty | 30,708 MBTU/H | [19,836 kW] |

*(Based on un-rounded flow rates)

A comparison of Tables II and IV shows that, compared to the prior art, the present invention improves propane recovery from 96.51% to 99.78% and butanes+ recovery from 99.68% to 100.00%. Comparison of Tables II and IV further shows that the improvement in yields was achieved using essentially the same horsepower and utility requirements.

Similar to the FIG. 3 embodiment of the present invention, the FIG. 4 embodiment of the present invention improves recoveries by providing supplemental rectification with reflux stream 52, which reduces the amount of propane and $C_4$+ components contained in the inlet feed gas that is lost to the residue gas. The FIG. 4 embodiment has the further advantage that splitting the reflux into two streams (streams 52 and 53) provides not only rectification of demethanizer overhead vapor stream 38, but partial rectification of distillation vapor stream 42 as well, reducing the amount of $C_3$ and heavier components in both streams compared to the FIG. 3 embodiment, as can be seen by comparing Tables III and IV. The result is 0.58 percentage points higher propane recovery than the FIG. 3 embodiment for the FIG. 4 embodiment, even though the ethane recovery level is much lower (50.89% versus 85.08%) for the FIG. 4 embodiment. The present invention allows maintaining a very high recovery level for the propane and heavier components regardless of the ethane recovery level, so that recovery of the propane and heavier components need never be compromised during times when ethane recovery must be curtailed to satisfy other plant constraints.

Other Embodiments

In accordance with this invention, it is generally advantageous to design the absorbing (rectification) section of the demethanizer to contain multiple theoretical separation stages. However, the benefits of the present invention can be achieved with as few as one theoretical stage, and it is believed that even the equivalent of a fractional theoretical stage may allow achieving these benefits. For instance, all or a part of the pumped condensed liquid (stream 44*a*) leaving reflux separator 23 and all or a part of the expanded substantially condensed stream 35*b* from expansion valve 16 can be combined (such as in the piping joining the expansion valve to the demethanizer) and if thoroughly intermingled, the vapors and liquids will mix together and separate in accordance with the relative volatilities of the various components of the total combined streams. Such commingling of the two streams shall be considered for the purposes of this invention as constituting an absorbing section.

Figure 5:
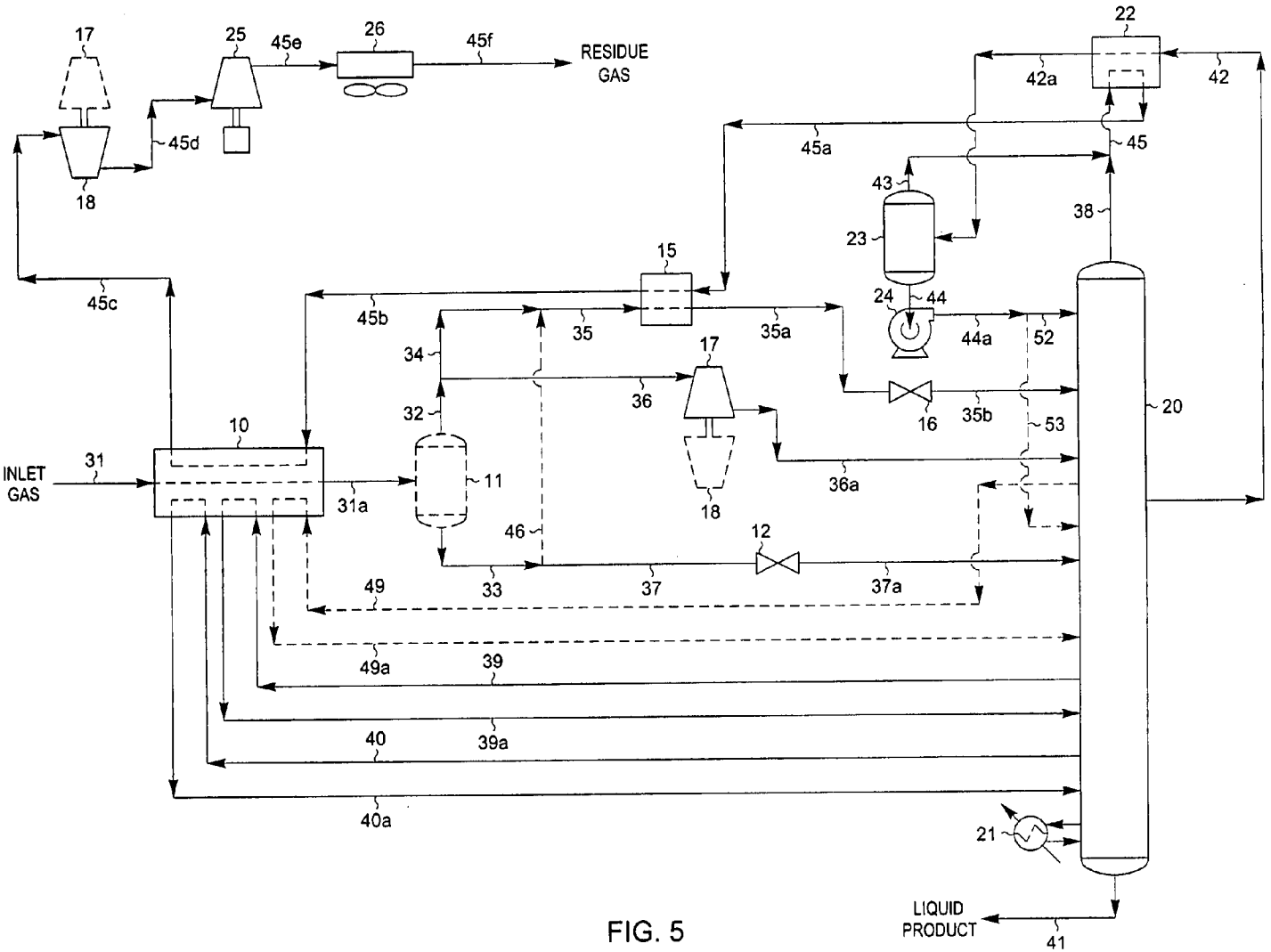
FIG. 5 is a flow diagram illustrating an alternative means of application of the present invention to a natural gas stream.

Some circumstances may favor mixing the remaining vapor portion of distillation stream 42*a* with the fractionation column overhead (stream 38), then supplying the mixed stream to heat exchanger 22 to provide cooling of distillation stream 42. This is shown in FIG. 5, where the mixed stream 45 resulting from combining the reflux separator vapor (stream 43) with the column overhead (stream 38) is routed to heat exchanger 22.

Figure 6:
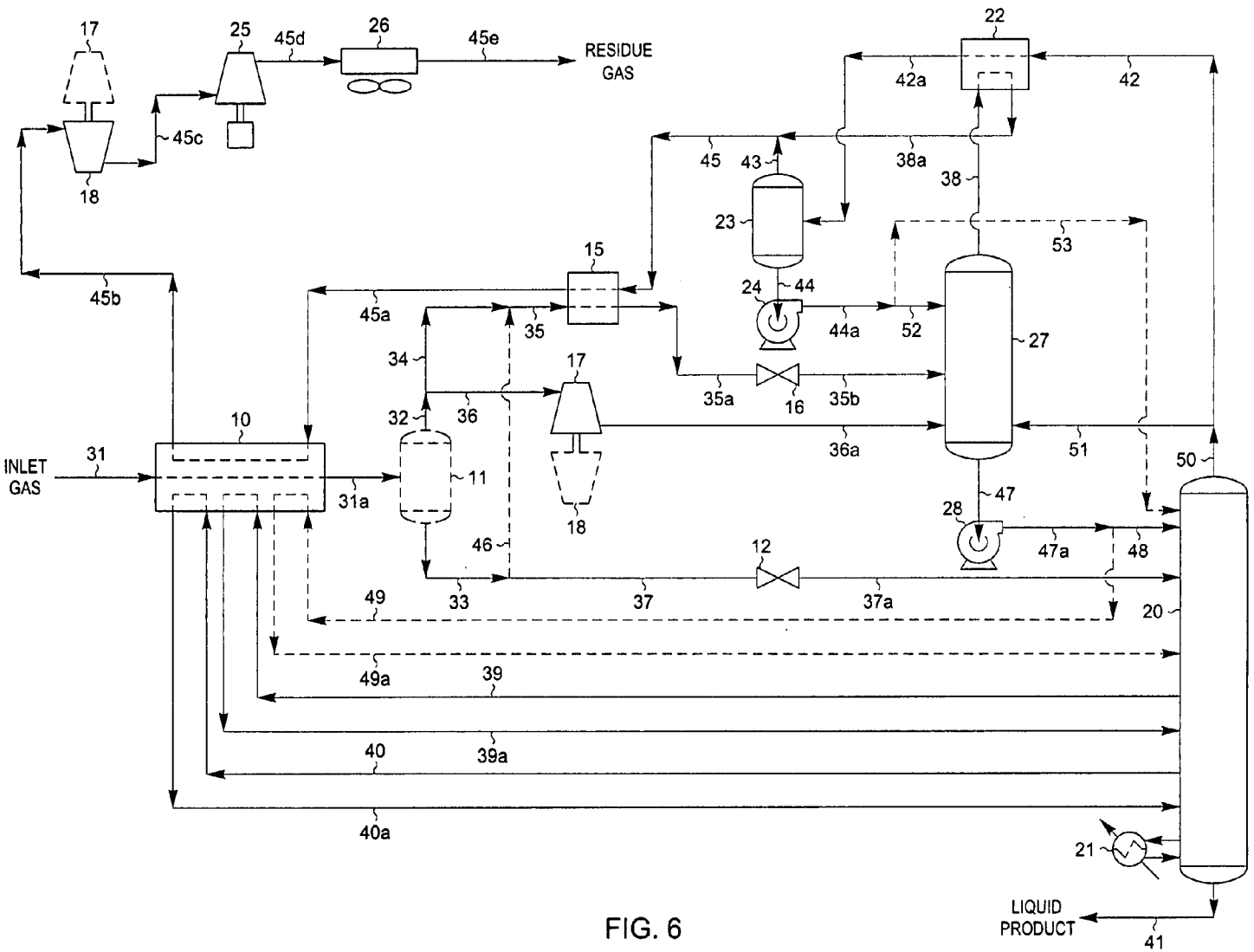
FIG. 6 is a flow diagram illustrating an alternative means of application of the present invention to a natural gas stream.

FIG. 6 depicts a fractionation tower constructed in two vessels, absorber (rectifier) column 27 and stripper column 20. In such cases, the overhead vapor (stream 50) from stripper column 20 is split into two portions. One portion (stream 42) is routed to heat exchanger 22 to generate reflux for absorber column 27 as described earlier. The remaining portion (stream 51) flows to the lower section of absorber column 27 to be contacted by expanded substantially condensed stream 35*b* and reflux liquid (stream 44*a*). Pump 28 is used to route the liquids (stream 47) from the bottom of absorber column 27 to the top of stripper column 20 so that the two towers effectively function as one distillation system. The decision whether to construct the fractionation tower as a single vessel (such as demethanizer 20 in FIGS. 3 through 5) or multiple vessels will depend on a number of factors such as plant size, the distance to fabrication facilities, etc.

As described earlier, the distillation vapor stream 42 is partially condensed and the resulting condensate used to absorb valuable $C_3$ components and heavier components from the vapors rising through absorbing section 20*a* of demethanizer 20. However, the present invention is not limited to this embodiment. It may be advantageous, for instance, to treat only a portion of these vapors in this manner, or to use only a portion of the condensate as an absorbent, in cases where other design considerations indicate portions of the vapors or the condensate should bypass absorbing section 20*a* of demethanizer 20. Some circumstances may favor total condensation, rather than partial condensation, of distillation stream 42 in heat exchanger 22. Other circumstances may favor that distillation stream 42 be a total vapor side draw from fractionation column 20 rather than a partial vapor side draw. It should also be noted that, depending on the composition of the feed gas stream, it may be advantageous to use external refrigeration to provide partial cooling of distillation vapor stream 42 in heat exchanger 22.

Feed gas conditions, plant size, available equipment, or other factors may indicate that elimination of work expansion machine 17, or replacement with an alternate expansion device (such as an expansion valve), is feasible. Although individual stream expansion is depicted in particular expansion devices, alternative expansion means may be employed where appropriate. For example, conditions may warrant work expansion of the substantially condensed portion of the feed stream (stream 35*a*).

In the practice of the present invention, there will necessarily be a slight pressure difference between demethanizer 20 and reflux separator 23 which must be taken into account. If the distillation vapor stream 42 passes through heat exchanger 22 and into reflux separator 23 without any boost in pressure, the reflux separator shall necessarily assume an operating pressure slightly below the operating pressure of demethanizer 20. In this case, the liquid stream withdrawn from the reflux separator can be pumped to its feed position(s) in the demethanizer. An alternative is to provide a booster blower for distillation vapor stream 42 to raise the operating pressure in heat exchanger 22 and reflux separator 23 sufficiently so that the liquid stream 44 can be supplied to demethanizer 20 without pumping.

Figure 7:
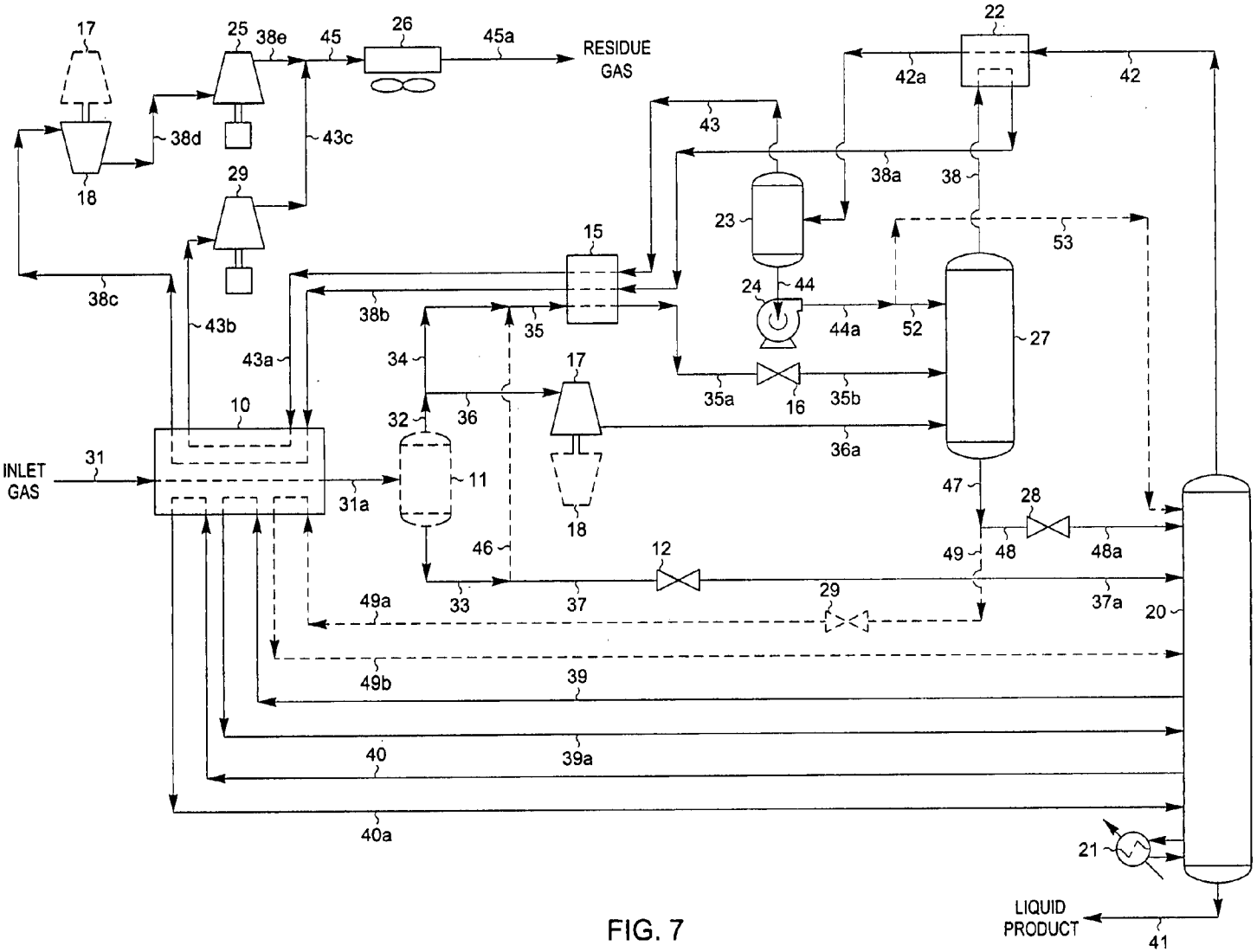
FIG. 7 is a flow diagram illustrating an alternative means of application of the present invention to a natural gas stream.

In those circumstances when the fractionation column is constructed as two vessels, it may be desirable to operate absorber column 27 at higher pressure than stripper column 20 as shown in FIG. 7. One manner of doing so is to use a separate compressor, such as compressor 29 in FIG. 7, to provide the motive force to cause distillation stream 42 to flow through heat exchanger 22. In such instances, the liquids from the bottom of absorber column 27 (stream 47) will be at elevated pressure relative to stripper column 20, so that a pump is not required to direct these liquids to stripper column 20. Instead, a suitable expansion device, such as expansion valve 28 in FIG. 7, can be used to expand the liquids to the operating pressure of stripper column 20 and the expanded stream 48*a* thereafter supplied to stripper column 20.

When the inlet gas is leaner, separator 11 in FIGS. 3 and 4 may not be justified. In such cases, the feed gas cooling accomplished in heat exchangers 10 and 13 in FIGS. 3 and 4 may be accomplished without an intervening separator as shown in FIGS. 5 through 7. The decision of whether or not to cool and separate the feed gas in multiple steps will depend on the richness of the feed gas, plant size, available equipment, etc. Depending on the quantity of heavier hydrocarbons in the feed gas and the feed gas pressure, the cooled feed stream 31*a* leaving heat exchanger 10 in FIGS. 3 through 7 and/or the cooled stream 32*a* leaving heat exchanger 13 in FIGS. 3 and 4 may not contain any liquid (because it is above its dewpoint, or because it is above its cricondenbar), so that separator 11 shown in FIGS. 3 through 7 and/or separator 14 shown in FIGS. 3 and 4 are not required.

The high pressure liquid (stream 37 in FIGS. 3 and 4 and stream 33 in FIGS. 5 through 7) need not be expanded and fed to a mid-column feed point on the distillation column. Instead, all or a portion of it may be combined with the portion of the separator vapor (stream 34 in FIGS. 3 through 7) flowing to heat exchanger 15. (This is shown by the dashed stream 46 in FIGS. 5 through 7.) Any remaining portion of the liquid may be expanded through an appropriate expansion device, such as an expansion valve or expansion machine, and fed to a mid-column feed point on the distillation column (stream 37*a* in FIGS. 5 through 7). Stream 33 in FIGS. 3 and 4 and stream 37 in FIGS. 3 through 7 may also be used for inlet gas cooling or other heat exchange service before or after the expansion step prior to flowing to the demethanizer, similar to what is shown in FIG. 4.

In accordance with this invention, the use of external refrigeration to supplement the cooling available to the inlet gas from other process streams may be employed, particularly in the case of a rich inlet gas. The use and distribution of separator liquids and demethanizer side draw liquids for process heat exchange, and the particular arrangement of heat exchangers for inlet gas cooling must be evaluated for each particular application, as well as the choice of process streams for specific heat exchange services.

Some circumstances may favor using a portion of the cold distillation liquid leaving absorbing section 20*a* for heat exchange, such as stream 49 in FIG. 4 and dashed stream 49 in FIG. 5. Although only a portion of the liquid from absorbing section 20*a* can be used for process heat exchange without reducing the ethane recovery in demethanizer 20, more duty can sometimes be obtained from these liquids than with liquids from stripping section 20*b*. This is because the liquids in absorbing section 20*a* of demethanizer 20 are available at a colder temperature level than those in stripping section 20*b*. This same feature can be accomplished when fractionation tower 20 is constructed as two vessels, as shown by dashed stream 49 in FIGS. 6 and 7. When the liquids from absorber column 27 are pumped as in FIG. 6, the liquid (stream 47*a*) leaving pump 28 can be split into two portions, with one portion (stream 49) used for heat exchange and then routed to a mid-column feed position on stripper column 20 (stream 49*a*). The remaining portion (stream 48) becomes the top feed to stripper column 20. Similarly, when absorber column 27 operates at elevated pressure relative to stripper column 20 as in FIG. 7, the liquid stream 47 can be split into two portions, with one portion (stream 49) expanded to the operating pressure of stripper column 20 (stream 49*a*), used for heat exchange, and then routed to a mid-column feed position on stripper column 20 (stream 49*b*). The remaining portion (stream 48) is likewise expanded to the operating pressure of stripper column 20 and stream 48*a* then becomes the top feed to stripper column 20. As shown by stream 53 in FIG. 4 and by dashed stream 53 in FIGS. 5 through 7, in such cases it may be advantageous to split the liquid stream from reflux pump 24 (stream 44*a*) into at least two streams so that a portion (stream 53) can be supplied to the stripping section of fractionation tower 20 (FIGS. 4 and 5) or to stripper column 20 (FIGS. 6 and 7) to increase the liquid flow in that part of the distillation system and improve the rectification of stream 42, while the remaining portion (stream 52) is supplied to the top of absorbing section 20*a* (FIGS. 4 and 5) or to the top of absorber column 27 (FIGS. 6 and 7).

In accordance with this invention, the splitting of the vapor feed may be accomplished in several ways. In the processes of FIGS. 3 through 7, the splitting of vapor occurs following cooling and separation of any liquids which may have been formed. The high pressure gas may be split, however, prior to any cooling of the inlet gas or after the cooling of the gas and prior to any separation stages. In some embodiments, vapor splitting may be effected in a separator.

It will also be recognized that the relative amount of feed found in each branch of the split vapor feed will depend on several factors, including gas pressure, feed gas composition, the amount of heat which can economically be extracted from the feed, and the quantity of horsepower available. More feed to the top of the column may increase recovery while decreasing power recovered from the expander thereby increasing the recompression horsepower requirements. Increasing feed lower in the column reduces the horsepower consumption but may also reduce product recovery. The relative locations of the mid-column feeds may vary depending on inlet composition or other factors such as desired recovery levels and amount of liquid formed during inlet gas cooling. Moreover, two or more of the feed streams, or portions thereof, may be combined depending on the relative temperatures and quantities of individual streams, and the combined stream then fed to a mid-column feed position.

The present invention provides improved recovery of $C_3$ components and heavier hydrocarbon components per amount of utility consumption required to operate the process. An improvement in utility consumption required for operating the demethanizer process may appear in the form of reduced power requirements for compression or recompression, reduced power requirements for external refrigeration, reduced energy requirements for tower reboilers, or a combination thereof.

While there have been described what are believed to be preferred embodiments of the invention, those skilled in the art will recognize that other and further modifications may be made thereto, e.g. to adapt the invention to various conditions, types of feed, or other requirements without departing from the spirit of the present invention as defined by the following claims.

We claim:

1. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is directed into a distillation column and fractionated at said lower pressure whereby the components of said relatively less volatile fraction are recovered;

the improvement wherein following cooling, said cooled stream is divided into first and second streams; and (1) said first stream is cooled to condense substantially all of it and is thereafter expanded to said lower pressure whereby it is further cooled;

(2) said expanded cooled first stream is thereafter supplied at a first mid-column feed position to said distillation column;

(3) said second stream is expanded to said lower pressure and is supplied to said distillation column at a second mid-column feed position;

(4) a vapor distillation stream is withdrawn from a region of said distillation column below said expanded second stream and is cooled sufficiently to condense at least a part of it, thereby forming a residual vapor stream and a condensed stream;

(5) at least a portion of said condensed stream is supplied to said distillation column at a top feed position;

(6) an overhead vapor stream is withdrawn from an upper region of said distillation column and is directed into heat exchange relation with said vapor distillation stream and heated, thereby to supply at least a portion of the cooling of step (4), and thereafter discharging at least a portion of said heated overhead vapor stream as said volatile residue gas fraction; and (7) the quantities and temperatures of said feed streams to said distillation column are effective to maintain the overhead temperature of said distillation column at a temperature whereby the major portions of the components in said relatively less volatile fraction are recovered.

2. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is directed into a distillation column and fractionated at said lower pressure whereby the components of said relatively less volatile fraction are recovered;

the improvement wherein following cooling, said cooled stream is divided into first and second streams; and (1) said first stream is cooled to condense substantially all of it and is thereafter expanded to said lower pressure whereby it is further cooled;

(2) said expanded cooled first stream is thereafter supplied at a first mid-column feed position to said distillation column;

(3) said second stream is expanded to said lower pressure and is supplied to said distillation column at a second mid-column feed position;

(4) a vapor distillation stream is withdrawn from a region of said distillation column below said expanded second stream and is cooled sufficiently to condense at least a part of it, thereby forming a residual vapor stream and a condensed stream;

(5) at least a portion of said condensed stream is supplied to said distillation column at a top feed position;

(6) an overhead vapor stream is withdrawn from an upper region of said distillation column and combined with said residual vapor stream to form a combined vapor stream;

(7) said combined vapor stream is directed into heat exchange relation with said vapor distillation stream and heated, thereby to supply at least a portion of the cooling of step (4), and thereafter discharging at least a portion of said heated combined vapor stream as said volatile residue gas fraction; and (8) the quantities and temperatures of said feed streams to said distillation column are effective to maintain the overhead temperature of said distillation column at a temperature whereby the major portions of the components in said relatively less volatile fraction are recovered.

3. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is directed into a distillation column and fractionated at said lower pressure whereby the components of said relatively less volatile fraction are recovered;

the improvement wherein prior to cooling, said gas is divided into first and second streams; and (1) said first stream is cooled to condense substantially all of it and is thereafter expanded to said lower pressure whereby it is further cooled;

(2) said expanded cooled first stream is thereafter supplied at a first mid-column feed position to said distillation column;

(3) said second stream is cooled and thereafter expanded to said lower pressure and supplied to said distillation column at a second mid-column feed position;

(4) a vapor distillation stream is withdrawn from a region of said distillation column below said expanded cooled second stream and is cooled sufficiently to condense at least a part of it, thereby forming a residual vapor stream and a condensed stream;

(5) at least a portion of said condensed stream is supplied to said distillation column at a top feed position;

(6) an overhead vapor stream is withdrawn from an upper region of said distillation column and is directed into heat exchange relation with said vapor distillation stream and heated, thereby to supply at least a portion of the cooling of step (4), and thereafter discharging at least a portion of said heated overhead vapor stream as said volatile residue gas fraction; and (7) the quantities and temperatures of said feed streams to said distillation column are effective to maintain the overhead temperature of said distillation column at a temperature whereby the major portions of the components in said relatively less volatile fraction are recovered.

4. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is directed into a distillation column and fractionated at said lower pressure whereby the components of said relatively less volatile fraction are recovered;

the improvement wherein prior to cooling, said gas is divided into first and second streams; and (1) said first stream is cooled to condense substantially all of it and is thereafter expanded to said lower pressure whereby it is further cooled;

(2) said expanded cooled first stream is thereafter supplied at a first mid-column feed position to said distillation column;

(3) said second stream is cooled and thereafter expanded to said lower pressure and supplied to said distillation column at a second mid-column feed position;

(4) a vapor distillation stream is withdrawn from a region of said distillation column below said expanded cooled second stream and is cooled sufficiently to condense at least a part of it, thereby forming a residual vapor stream and a condensed stream;

(5) at least a portion of said condensed stream is supplied to said distillation column at a top feed position;

(6) an overhead vapor stream is withdrawn from an upper region of said distillation column and combined with said residual vapor stream to form a combined vapor stream;

(7) said combined vapor stream is directed into heat exchange relation with said vapor distillation stream and heated, thereby to supply at least a portion of the cooling of step (4), and thereafter discharging at least a portion of said heated combined vapor stream as said volatile residue gas fraction; and (8) the quantities and temperatures of said feed streams to said distillation column are effective to maintain the overhead temperature of said distillation column at a temperature whereby the major portions of the components in said relatively less volatile fraction are recovered.

5. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is directed into a distillation column and fractionated at said lower pressure whereby the components of said relatively less volatile fraction are recovered;

the improvement wherein said gas stream is cooled sufficiently to partially condense it; and (1) said partially condensed gas stream is separated thereby to provide a vapor stream and at least one liquid stream;

(2) said vapor stream is thereafter divided into first and second streams;

(3) said first stream is cooled to condense substantially all of it and is thereafter expanded to said lower pressure whereby it is further cooled;

(4) said expanded cooled first stream is thereafter supplied at a first mid-column feed position to said distillation column;

(5) said second stream is expanded to said lower pressure and is supplied to said distillation column at a second mid-column feed position;

(6) at least a portion of said at least one liquid stream is expanded to said lower pressure and is supplied to said distillation column at a third mid-column feed position;

(7) a vapor distillation stream is withdrawn from a region of said distillation column below said expanded second stream and is cooled sufficiently to condense at least a part of it, thereby forming a residual vapor stream and a condensed stream;

(8) at least a portion of said condensed stream is supplied to said distillation column at a top feed position;

(9) an overhead vapor stream is withdrawn from an upper region of said distillation column and is directed into heat exchange relation with said vapor distillation stream and heated, thereby to supply at least a portion of the cooling of step (7), and thereafter discharging at least a portion of said heated overhead vapor stream as said volatile residue gas fraction; and

(10) the quantities and temperatures of said feed streams to said distillation column are effective to maintain the overhead temperature of said distillation column at a temperature whereby the major portions of the components in said relatively less volatile fraction are recovered.

6. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is directed into a distillation column and fractionated at said lower pressure whereby the components of said relatively less volatile fraction are recovered;

the improvement wherein said gas stream is cooled sufficiently to partially condense it; and (1) said partially condensed gas stream is separated thereby to provide a vapor stream and at least one liquid stream;

(2) said vapor stream is thereafter divided into first and second streams;

(3) said first stream is cooled to condense substantially all of it and is thereafter expanded to said lower pressure whereby it is further cooled;

(4) said expanded cooled first stream is thereafter supplied at a first mid-column feed position to said distillation column;

(5) said second stream is expanded to said lower pressure and is supplied to said distillation column at a second mid-column feed position;

(6) at least a portion of said at least one liquid stream is expanded to said lower pressure and is supplied to said distillation column at a third mid-column feed position;

(7) a vapor distillation stream is withdrawn from a region of said distillation column below said expanded second stream and is cooled sufficiently to condense at least a part of it, thereby forming a residual vapor stream and a condensed stream;

(8) at least a portion of said condensed stream is supplied to said distillation column at a top feed position;

(9) an overhead vapor stream is withdrawn from an upper region of said distillation column and combined with said residual vapor stream to form a combined vapor stream;

(10) said combined vapor stream is directed into heat exchange relation with said vapor distillation stream and heated, thereby to supply at least a portion of the cooling of step (7), and thereafter discharging at least a portion of said heated combined vapor stream as said volatile residue gas fraction; and

(11) the quantities and temperatures of said feed streams to said distillation column are effective to maintain the overhead temperature of said distillation column at a temperature whereby the major portions of the components in said relatively less volatile fraction are recovered.

7. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is directed into a distillation column and fractionated at said lower pressure whereby the components of said relatively less volatile fraction are recovered;

the improvement wherein said gas stream is cooled sufficiently to partially condense it; and (1) said partially condensed gas stream is separated thereby to provide a vapor stream and at least one liquid stream;

(2) said vapor stream is thereafter divided into first and second streams;

(3) said first stream is combined with at least a portion of said at least one liquid stream to form a combined stream, and said combined stream is cooled to condense substantially all of it and is thereafter expanded to said lower pressure whereby it is further cooled;

(4) said expanded cooled combined stream is thereafter supplied at a first mid-column feed position to said distillation column;

(5) said second stream is expanded to said lower pressure and is supplied to said distillation column at a second mid-column feed position;

(6) any remaining portion of said at least one liquid stream is expanded to said lower pressure and is supplied to said distillation column at a third mid-column feed position;

(7) a vapor distillation stream is withdrawn from a region of said distillation column below said expanded second stream and is cooled sufficiently to condense at least a part of it, thereby forming a residual vapor stream and a condensed stream;

(8) at least a portion of said condensed stream is supplied to said distillation column at a top feed position;

(9) an overhead vapor stream is withdrawn from an upper region of said distillation column and is directed into heat exchange relation with said vapor distillation stream and heated, thereby to supply at least a portion of the cooling of step (7), and thereafter discharging at least a portion of said heated overhead vapor stream as said volatile residue gas fraction; and

(10) the quantities and temperatures of said feed streams to said distillation column are effective to maintain the overhead temperature of said distillation column at a temperature whereby the major portions of the components in said relatively less volatile fraction are recovered.

8. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is directed into a distillation column and fractionated at said lower pressure whereby the components of said relatively less volatile fraction are recovered;

the improvement wherein said gas stream is cooled sufficiently to partially condense it; and (1) said partially condensed gas stream is separated thereby to provide a vapor stream and at least one liquid stream;

(2) said vapor stream is thereafter divided into first and second streams;

(3) said first stream is combined with at least a portion of said at least one liquid stream to form a combined stream, and said combined stream is cooled to condense substantially all of it and is thereafter expanded to said lower pressure whereby it is further cooled;

(4) said expanded cooled combined stream is thereafter supplied at a first mid-column feed position to said distillation column;

(5) said second stream is expanded to said lower pressure and is supplied to said distillation column at a second mid-column feed position;

(6) any remaining portion of said at least one liquid stream is expanded to said lower pressure and is supplied to said distillation column at a third mid-column feed position;

(7) a vapor distillation stream is withdrawn from a region of said distillation column below said expanded second stream and is cooled sufficiently to condense at least a part of it, thereby forming a residual vapor stream and a condensed stream;

(8) at least a portion of said condensed stream is supplied to said distillation column at a top feed position;

(9) an overhead vapor stream is withdrawn from an upper region of said distillation column and combined with said residual vapor stream to form a combined vapor stream;

(10) said combined vapor stream is directed into heat exchange relation with said vapor distillation stream and heated, thereby to supply at least a portion of the cooling of step (7), and thereafter discharging at least a portion of said heated combined vapor stream as said volatile residue gas fraction; and

(11) the quantities and temperatures of said feed streams to said distillation column are effective to maintain the overhead temperature of said distillation column at a temperature whereby the major portions of the components in said relatively less volatile fraction are recovered.

9. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is directed into a distillation column and fractionated at said lower pressure whereby the components of said relatively less volatile fraction are recovered;

the improvement wherein prior to cooling, said gas is divided into first and second streams; and (1) said first stream is cooled to condense substantially all of it and is thereafter expanded to said lower pressure whereby it is further cooled;

(2) said expanded cooled first stream is thereafter supplied at a first mid-column feed position to said distillation column;

(3) said second stream is cooled under pressure sufficiently to partially condense it;

(4) said partially condensed second stream is separated thereby to provide a vapor stream and at least one liquid stream;

(5) said vapor stream is expanded to said lower pressure and supplied to said distillation column at a second mid-column feed position;

(6) at least a portion of said at least one liquid stream is expanded to said lower pressure and is supplied to said distillation column at a third mid-column feed position;

(7) a vapor distillation stream is withdrawn from a region of said distillation column below said expanded vapor stream and is cooled sufficiently to condense at least a part of it, thereby forming a residual vapor stream and a condensed stream;

(8) at least a portion of said condensed stream is supplied to said distillation column at a top feed position;

(9) an overhead vapor stream is withdrawn from an upper region of said distillation column and is directed into heat exchange relation with said vapor distillation stream and heated, thereby to supply at least a portion of the cooling of step (7), and thereafter discharging at least a portion of said heated overhead vapor stream as said volatile residue gas fraction; and

(10) the quantities and temperatures of said feed streams to said distillation column are effective to maintain the overhead temperature of said distillation column at a temperature whereby the major portions of the components in said relatively less volatile fraction are recovered.

10. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is directed into a distillation column and fractionated at said lower pressure whereby the components of said relatively less volatile fraction are recovered;

the improvement wherein prior to cooling, said gas is divided into first and second streams; and (1) said first stream is cooled to condense substantially all of it and is thereafter expanded to said lower pressure whereby it is further cooled;

(2) said expanded cooled first stream is thereafter supplied at a first mid-column feed position to said distillation column;

(3) said second stream is cooled under pressure sufficiently to partially condense it;

(4) said partially condensed second stream is separated thereby to provide a vapor stream and at least one liquid stream;

(5) said vapor stream is expanded to said lower pressure and supplied to said distillation column at a second mid-column feed position;

(6) at least a portion of said at least one liquid stream is expanded to said lower pressure and is supplied to said distillation column at a third mid-column feed position;

(7) a vapor distillation stream is withdrawn from a region of said distillation column below said expanded vapor stream and is cooled sufficiently to condense at least a part of it, thereby forming a residual vapor stream and a condensed stream;

(8) at least a portion of said condensed stream is supplied to said distillation column at a top feed position;

(9) an overhead vapor stream is withdrawn from an upper region of said distillation column and combined with said residual vapor stream to form a combined vapor stream;

(10) said combined vapor stream is directed into heat exchange relation with said vapor distillation stream and heated, thereby to supply at least a portion of the cooling of step (7), and thereafter discharging at least a portion of said heated combined vapor stream as said volatile residue gas fraction; and

(11) the quantities and temperatures of said feed streams to said distillation column are effective to maintain the overhead temperature of said distillation column at a temperature whereby the major portions of the components in said relatively less volatile fraction are recovered.

11. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is directed into a distillation column and fractionated at said lower pressure whereby the components of said relatively less volatile fraction are recovered;

the improvement wherein following cooling, said cooled stream is divided into first and second streams; and (1) said first stream is cooled to condense substantially all of it and is thereafter expanded to said lower pressure whereby it is further cooled;

(2) said expanded cooled first stream is thereafter supplied at a first mid-column feed position to a contacting and separating device that produces an overhead vapor stream and a bottom liquid stream, whereupon said bottom liquid stream is supplied to said distillation column;

(3) said second stream is expanded to said lower pressure and is supplied to said contacting and separating device at a second mid-column feed position;

(4) a vapor distillation stream is withdrawn from an upper region of said distillation column and is cooled sufficiently to condense at least a part of it, thereby forming a residual vapor stream and a condensed stream;

(5) at least a portion of said condensed stream is supplied to said contacting and separating device at a top feed position;

(6) said overhead vapor stream is directed into heat exchange relation with said vapor distillation stream and heated, thereby to supply at least a portion of the cooling of step (4), and thereafter discharging at least a portion of said heated overhead vapor stream as said volatile residue gas fraction; and (7) the quantities and temperatures of said feed streams to said contacting and separating device are effective to maintain the overhead temperature of said contacting and separating device at a temperature whereby the major portions of the components in said relatively less volatile fraction are recovered.

12. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is directed into a distillation column and fractionated at said lower pressure whereby the components of said relatively less volatile fraction are recovered;

the improvement wherein following cooling, said cooled stream is divided into first and second streams; and (1) said first stream is cooled to condense substantially all of it and is thereafter expanded to said lower pressure whereby it is further cooled;

(2) said expanded cooled first stream is thereafter supplied at a first mid-column feed position to a contacting and separating device that produces an overhead vapor stream and a bottom liquid stream, whereupon said bottom liquid stream is supplied to said distillation column;

(3) said second stream is expanded to said lower pressure and is supplied to said contacting and separating device at a second mid-column feed position;

(4) a vapor distillation stream is withdrawn from an upper region of said distillation column and is cooled sufficiently to condense at least a part of it, thereby forming a residual vapor stream and a condensed stream;

(5) at least a portion of said condensed stream is supplied to said contacting and separating device at a top feed position;

(6) said overhead vapor stream is combined with said residual vapor stream to form a combined vapor stream;

(7) said combined vapor stream is directed into heat exchange relation with said vapor distillation stream and heated, thereby to supply at least a portion of the cooling of step (4), and thereafter discharging at least a portion of said heated combined vapor stream as said volatile residue gas fraction; and (8) the quantities and temperatures of said feed streams to said contacting and separating device are effective to maintain the overhead temperature of said contacting and separating device at a temperature whereby the major portions of the components in said relatively less volatile fraction are recovered.

13. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is directed into a distillation column and fractionated at said lower pressure whereby the components of said relatively less volatile fraction are recovered;

the improvement wherein prior to cooling, said gas is divided into first and second streams; and (1) said first stream is cooled to condense substantially all of it and is thereafter expanded to said lower pressure whereby it is further cooled;

(2) said expanded cooled first stream is thereafter supplied at a first mid-column feed position to a contacting and separating device that produces an overhead vapor stream and a bottom liquid stream, whereupon said bottom liquid stream is supplied to said distillation column;

(3) said second stream is cooled and thereafter expanded to said lower pressure and is supplied to said contacting and separating device at a second mid-column feed position;

(4) a vapor distillation stream is withdrawn from an upper region of said distillation column and is cooled sufficiently to condense at least a part of it, thereby forming a residual vapor stream and a condensed stream;

(5) at least a portion of said condensed stream is supplied to said contacting and separating device at a top feed position;

(6) said overhead vapor stream is directed into heat exchange relation with said vapor distillation stream and heated, thereby to supply at least a portion of the cooling of step (4), and thereafter discharging at least a portion of said heated overhead vapor stream as said volatile residue gas fraction; and (7) the quantities and temperatures of said feed streams to said contacting and separating device are effective to maintain the overhead temperature of said contacting and separating device at a temperature whereby the major portions of the components in said relatively less volatile fraction are recovered.

14. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is directed into a distillation column and fractionated at said lower pressure whereby the components of said relatively less volatile fraction are recovered;

the improvement wherein prior to cooling, said gas is divided into first and second streams; and (1) said first stream is cooled to condense substantially all of it and is thereafter expanded to said lower pressure whereby it is further cooled;

(2) said expanded cooled first stream is thereafter supplied at a first mid-column feed position to a contacting and separating device that produces an overhead vapor stream and a bottom liquid stream, whereupon said bottom liquid stream is supplied to said distillation column;

(3) said second stream is cooled and thereafter expanded to said lower pressure and is supplied to said contacting and separating device at a second mid-column feed position;

(4) a vapor distillation stream is withdrawn from an upper region of said distillation column and is cooled sufficiently to condense at least a part of it, thereby forming a residual vapor stream and a condensed stream;

(5) at least a portion of said condensed stream is supplied to said contacting and separating device at a top feed position;

(6) said overhead vapor stream is combined with said residual vapor stream to form a combined vapor stream;

(7) said combined vapor stream is directed into heat exchange relation with said vapor distillation stream and heated, thereby to supply at least a portion of the cooling of step (4), and thereafter discharging at least a portion of said heated combined vapor stream as said volatile residue gas fraction; and (8) the quantities and temperatures of said feed streams to said contacting and separating device are effective to maintain the overhead temperature of said contacting and separating device at a temperature whereby the major portions of the components in said relatively less volatile fraction are recovered.

15. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is directed into a distillation column and fractionated at said lower pressure whereby the components of said relatively less volatile fraction are recovered;

the improvement wherein said gas stream is cooled sufficiently to partially condense it; and (1) said partially condensed gas stream is separated thereby to provide a vapor stream and at least one liquid stream;

(2) said vapor stream is thereafter divided into first and second streams;

(3) said first stream is cooled to condense substantially all of it and is thereafter expanded to said lower pressure whereby it is further cooled;

(4) said expanded cooled first stream is thereafter supplied at a first mid-column feed position to a contacting and separating device that produces an overhead vapor stream and a bottom liquid stream, whereupon said bottom liquid stream is supplied to said distillation column;

(5) said second stream is expanded to said lower pressure and is supplied to said contacting and separating device at a second mid-column feed position;

(6) at least a portion of said at least one liquid stream is expanded to said lower pressure and is supplied to said contacting and separating device at a third mid-column feed position;

(7) a vapor distillation stream is withdrawn from an upper region of said distillation column and is cooled sufficiently to condense at least a part of it, thereby forming a residual vapor stream and a condensed stream;

(8) at least a portion of said condensed stream is supplied to said contacting and separating device at a top feed position;

(9) said overhead vapor stream is directed into heat exchange relation with said vapor distillation stream and heated, thereby to supply at least a portion of the cooling of step (7), and thereafter discharging at least a portion of said heated overhead vapor stream as said volatile residue gas fraction; and

(10) the quantities and temperatures of said feed streams to said contacting and separating device are effective to maintain the overhead temperature of said contacting and separating device at a temperature whereby the major portions of the components in said relatively less volatile fraction are recovered.

16. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is directed into a distillation column and fractionated at said lower pressure whereby the components of said relatively less volatile fraction are recovered;

the improvement wherein said gas stream is cooled sufficiently to partially condense it; and (1) said partially condensed gas stream is separated thereby to provide a vapor stream and at least one liquid stream;

(2) said vapor stream is thereafter divided into first and second streams;

(3) said first stream is cooled to condense substantially all of it and is thereafter expanded to said lower pressure whereby it is further cooled;

(4) said expanded cooled first stream is thereafter supplied at a first mid-column feed position to a contacting and separating device that produces an overhead vapor stream and a bottom liquid stream, whereupon said bottom liquid stream is supplied to said distillation column;

(5) said second stream is expanded to said lower pressure and is supplied to said contacting and separating device at a second mid-column feed position;

(6) at least a portion of said at least one liquid stream is expanded to said lower pressure and is supplied to said contacting and separating device at a third mid-column feed position;

(7) a vapor distillation stream is withdrawn from an upper region of said distillation column and is cooled sufficiently to condense at least a part of it, thereby forming a residual vapor stream and a condensed stream;

(8) at least a portion of said condensed stream is supplied to said contacting and separating device at a top feed position;

(9) said overhead vapor stream is combined with said residual vapor stream to form a combined vapor stream;

(10) said combined vapor stream is directed into heat exchange relation with said vapor distillation stream and heated, thereby to supply at least a portion of the cooling of step (7), and thereafter discharging at least a portion of said heated combined vapor stream as said volatile residue gas fraction; and

(11) the quantities and temperatures of said feed streams to said contacting and separating device are effective to maintain the overhead temperature of said contacting and separating device at a temperature whereby the major portions of the components in said relatively less volatile fraction are recovered.

17. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is directed into a distillation column and fractionated at said lower pressure whereby the components of said relatively less volatile fraction are recovered;

the improvement wherein said gas stream is cooled sufficiently to partially condense it; and (1) said partially condensed gas stream is separated thereby to provide a vapor stream and at least one liquid stream;

(2) said vapor stream is thereafter divided into first and second streams;

(3) said first stream is combined with at least a portion of said at least one liquid stream to form a combined stream, and said combined stream is cooled to condense substantially all of it and is thereafter expanded to said lower pressure whereby it is further cooled;

(4) said expanded cooled combined stream is thereafter supplied at a first mid-column feed position to a contacting and separating device that produces an overhead vapor stream and a bottom liquid stream, whereupon said bottom liquid stream is supplied to said distillation column;

(5) said second stream is expanded to said lower pressure and is supplied to said contacting and separating device at a second mid-column feed position;

(6) any remaining portion of said at least one liquid stream is expanded to said lower pressure and is supplied to said contacting and separating device at a third mid-column feed position;

(7) a vapor distillation stream is withdrawn from an upper region of said distillation column and is cooled sufficiently to condense at least a part of it, thereby forming a residual vapor stream and a condensed stream;

(8) at least a portion of said condensed stream is supplied to said contacting and separating device at a top feed position;

(9) said overhead vapor stream is directed into heat exchange relation with said vapor distillation stream and heated, thereby to supply at least a portion of the cooling of step (7), and thereafter discharging at least a portion of said heated overhead vapor stream as said volatile residue gas fraction; and

(10) the quantities and temperatures of said feed streams to said contacting and separating device are effective to maintain the overhead temperature of said contacting and separating device at a temperature whereby the major portions of the components in said relatively less volatile fraction are recovered.

18. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is directed into a distillation column and fractionated at said lower pressure whereby the components of said relatively less volatile fraction are recovered;

the improvement wherein said gas stream is cooled sufficiently to partially condense it; and (1) said partially condensed gas stream is separated thereby to provide a vapor stream and at least one liquid stream;

(2) said vapor stream is thereafter divided into first and second streams;

(3) said first stream is combined with at least a portion of said at least one liquid stream to form a combined stream, and said combined stream is cooled to condense substantially all of it and is thereafter expanded to said lower pressure whereby it is further cooled;

(4) said expanded cooled combined stream is thereafter supplied at a first mid-column feed position to a contacting and separating device that produces an overhead vapor stream and a bottom liquid stream, whereupon said bottom liquid stream is supplied to said distillation column;

(5) said second stream is expanded to said lower pressure and is supplied to said contacting and separating device at a second mid-column feed position;

(6) any remaining portion of said at least one liquid stream is expanded to said lower pressure and is supplied to said contacting and separating device at a third mid-column feed position;

(7) a vapor distillation stream is withdrawn from an upper region of said distillation column and is cooled sufficiently to condense at least a part of it, thereby forming a residual vapor stream and a condensed stream;

(8) at least a portion of said condensed stream is supplied to said contacting and separating device at a top feed position;

(9) said overhead vapor stream is combined with said residual vapor stream to form a combined vapor stream;

(10) said combined vapor stream is directed into heat exchange relation with said vapor distillation stream and heated, thereby to supply at least a portion of the cooling of step (7), and thereafter discharging at least a portion of said heated combined vapor stream as said volatile residue gas fraction; and

(11) the quantities and temperatures of said feed streams to said contacting and separating device are effective to maintain the overhead temperature of said contacting and separating device at a temperature whereby the major portions of the components in said relatively less volatile fraction are recovered.

19. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is directed into a distillation column and fractionated at said lower pressure whereby the components of said relatively less volatile fraction are recovered;

the improvement wherein prior to cooling, said gas is divided into first and second streams; and (1) said first stream is cooled to condense substantially all of it and is thereafter expanded to said lower pressure whereby it is further cooled;

(2) said expanded cooled first stream is thereafter supplied at a first mid-column feed position to a contacting and separating device that produces an overhead vapor stream and a bottom liquid stream, whereupon said bottom liquid stream is supplied to said distillation column;

(3) said second stream is cooled under pressure sufficiently to partially condense it;

(4) said partially condensed second stream is separated thereby to provide a vapor stream and at least one liquid stream;

(5) said vapor stream is expanded to said lower pressure and supplied to said contacting and separating device at a second mid-column feed position;

(6) at least a portion of said at least one liquid stream is expanded to said lower pressure and is supplied to said contacting and separating device at a third mid-column feed position;

(7) a vapor distillation stream is withdrawn from an upper region of said distillation column and is cooled sufficiently to condense at least a part of it, thereby forming a residual vapor stream and a condensed stream;

(8) at least a portion of said condensed stream is supplied to said contacting and separating device at a top feed position;

(9) said overhead vapor stream is directed into heat exchange relation with said vapor distillation stream and heated, thereby to supply at least a portion of the cooling, of step (7), and thereafter discharging at least a portion of said heated overhead vapor stream as said volatile residue gas fraction; and

(10) the quantities and temperatures of said feed streams to said contacting and separating device are effective to maintain the overhead temperature of said contacting and separating device at a temperature whereby the major portions of the components in said relatively less volatile fraction are recovered.

20. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is directed into a distillation column and fractionated at said lower pressure whereby the components of said relatively less volatile fraction are recovered;

the improvement wherein prior to cooling, said gas is divided into first and second streams; and (1) said first stream is cooled to condense substantially all of it and is thereafter expanded to said lower pressure whereby it is further cooled;

(2) said expanded cooled first stream is thereafter supplied at a first mid-column feed position to a contacting and separating device that produces an overhead vapor stream and a bottom liquid stream, whereupon said bottom liquid stream is supplied to said distillation column;

(3) said second stream is cooled under pressure sufficiently to partially condense it;

(4) said partially condensed second stream is separated thereby to provide a vapor stream and at least one liquid stream;

(5) said vapor stream is expanded to said lower pressure and supplied to said contacting and separating device at a second mid-column feed position;

(6) at least a portion of said at least one liquid stream is expanded to said lower pressure and is supplied to said contacting and separating device at a third mid-column feed position;

(7) a vapor distillation stream is withdrawn from an upper region of said distillation column and is cooled sufficiently to condense at least a part of it, thereby forming a residual vapor stream and a condensed stream;

(8) at least a portion of said condensed stream is supplied to said contacting and separating device at a top feed position;

(9) said overhead vapor stream is combined with said residual vapor stream to form a combined vapor stream;

(10) said combined vapor stream is directed into heat exchange relation with said vapor distillation stream and heated, thereby to supply at least a portion of the cooling of step (7), and thereafter discharging at least a portion of said heated combined vapor stream as said volatile residue gas fraction; and

(11) the quantities and temperatures of said feed streams to said contacting and separating device are effective to maintain the overhead temperature of said contacting and separating device at a temperature whereby the major portions of the components in said relatively less volatile fraction are recovered.

21. The improvement according to claim 1, 2, 3, 4, 5, 6, 7, 8, 9, or 10 wherein (1) said condensed stream is divided into at least a first portion and a second portion;

(2) said first portion is supplied to said distillation column at a top feed position; and (3) said second portion is supplied to said distillation column at a feed position in substantially the same region wherein said vapor distillation stream is withdrawn.

22. The improvement according to claim 11, 12, 13, 14, 15, 16, 17, 18, 19, or 20 wherein (1) said condensed stream is divided into at least a first portion and a second portion;

(2) said first portion is supplied to said contacting and separating device at a top feed position; and (3) said second portion is supplied to said distillation column at a top feed position.

23. In an apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a distillation column connected to receive said further cooled stream, said distillation column being adapted to separate said further cooled stream into an overhead vapor stream and said relatively less volatile fraction;

the improvement wherein said apparatus includes (1) dividing means connected to said first cooling means to receive said cooled stream and to divide it into first and second streams;

(2) second cooling means connected to said dividing means to receive said first stream and to cool it sufficiently to substantially condense it;

(3) second expansion means connected to said second cooling means to receive said substantially condensed first stream and to expand it to said lower pressure, said second expansion means being further connected to said distillation column to supply said expanded cooled first stream to said distillation column at a first mid-column feed position;

(4) said first expansion means being connected to said dividing means to receive said second stream and to expand it to said lower pressure, said first expansion means being further connected to said distillation column to supply said expanded second stream to said distillation column at a second mid-column feed position;

(5) vapor withdrawing means connected to said distillation column to receive a vapor distillation stream from a region of said distillation column below said expanded second stream;

(6) heat exchange means connected to said vapor withdrawing means to receive said vapor distillation stream and cool it sufficiently to condense at least a part of it;

(7) separating means connected to said heat exchange means to receive said partially condensed distillation stream and separate it, thereby forming a residual vapor stream and a condensed stream, said separating means being further connected to said distillation column to supply at least a portion of said condensed stream to said distillation column at a top feed position;

(8) said distillation column being further connected to said heat exchange means to direct at least a portion of said overhead vapor stream separated therein into heat exchange relation with said vapor distillation stream and heat said overhead vapor stream, thereby to supply at least a portion of the cooling of step (6), and thereafter discharging at least a portion of said heated overhead vapor stream as said volatile residue gas fraction; and (9) control means adapted to regulate the quantities and temperatures of said feed streams to said distillation column to maintain the overhead temperature of said distillation column at a temperature whereby the major portions of the components in said relatively less volatile fraction are recovered.

24. In an apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a distillation column connected to receive said further cooled stream, said distillation column being adapted to separate said further cooled stream into an overhead vapor stream and said relatively less volatile fraction;

the improvement wherein said apparatus includes (1) dividing means connected to said first cooling means to receive said cooled stream and to divide it into first and second streams;

(2) second cooling means connected to said dividing means to receive said first stream and to cool it sufficiently to substantially condense it;

(3) second expansion means connected to said second cooling means to receive said substantially condensed first stream and to expand it to said lower pressure, said second expansion means being further connected to said distillation column to supply said expanded cooled first stream to said distillation column at a first mid-column feed position;

(4) said first expansion means being connected to said dividing means to receive said second stream and to expand it to said lower pressure, said first expansion means being further connected to said distillation column to supply said expanded second stream to said distillation column at a second mid-column feed position;

(5) vapor withdrawing means connected to said distillation column to receive a vapor distillation stream from a region of said distillation column below said expanded second stream;

(6) heat exchange means connected to said vapor withdrawing means to receive said vapor distillation stream and cool it sufficiently to condense at least a part of it;

(7) separating means connected to said heat exchange means to receive said partially condensed distillation stream and separate it, thereby forming a residual vapor stream and a condensed stream, said separating means being further connected to said distillation column to supply at least a portion of said condensed stream to said distillation column at a top feed position;

(8) combining means connected to said distillation column and said separating means to receive said overhead vapor stream and said residual vapor stream and form a combined vapor stream;

(9) said combining means being further connected to said heat exchange means to direct at least a portion of said combined vapor stream into heat exchange relation with said vapor distillation stream and heat said combined vapor stream, thereby to supply at least a portion of the cooling of step (6), and thereafter discharging at least a portion of said heated combined vapor stream as said volatile residue gas fraction; and

(10) control means adapted to regulate the quantities and temperatures of said feed streams to said distillation column to maintain the overhead temperature of said distillation column at a temperature whereby the major portions of the components in said relatively less volatile fraction are recovered.

25. In an apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a distillation column connected to receive said further cooled stream, said distillation column being adapted to separate said further cooled stream into an overhead vapor stream and said relatively less volatile fraction;

the improvement wherein said apparatus includes (1) dividing means prior to said first cooling means to divide said feed gas into first and second streams;

(2) second cooling means connected to said dividing means to receive said first stream and to cool it sufficiently to substantially condense it;

(3) second expansion means connected to said second cooling means to receive said substantially condensed first stream and to expand it to said lower pressure, said second expansion means being further connected to said distillation column to supply said expanded cooled first stream to said distillation column at a first mid-column feed position;

(4) said first cooling means being connected to said dividing means to receive said second stream and to cool it;

(5) said first expansion means being connected to said first cooling means to receive said cooled second stream and to expand it to said lower pressure, said first expansion means being further connected to said distillation column to supply said expanded cooled second stream to said distillation column at a second mid-column feed position;

(6) vapor withdrawing means connected to said distillation column to receive a vapor distillation stream from a region of said distillation column below said expanded cooled second stream;

(7) heat exchange means connected to said vapor withdrawing means to receive said vapor distillation stream and cool it sufficiently to condense at least a part of it;

(8) separating means connected to said heat exchange means to receive said partially condensed distillation stream and separate it, thereby forming a residual vapor stream and a condensed stream, said separating means being further connected to said distillation column to supply at least a portion of said condensed stream to said distillation column at a top feed position;

(9) said distillation column being further connected to said heat exchange means to direct at least a portion of said overhead vapor stream separated therein into heat exchange relation with said vapor distillation stream and heat said overhead vapor stream, thereby to supply at least a portion of the cooling of step (7), and thereafter discharging at least a portion of said heated overhead vapor stream as said volatile residue gas fraction; and

(10) control means adapted to regulate the quantities and temperatures of said feed streams to said distillation column to maintain the overhead temperature of said distillation column at a temperature whereby the major portions of the components in said relatively less volatile fraction are recovered.

26. In an apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a distillation column connected to receive said further cooled stream, said distillation column being adapted to separate said further cooled stream into an overhead vapor stream and said relatively less volatile fraction;

the improvement wherein said apparatus includes (1) dividing means prior to said first cooling means to divide said feed gas into first and second streams;

(2) second cooling means connected to said dividing means to receive said first stream and to cool it sufficiently to substantially condense it;

(3) second expansion means connected to said second cooling means to receive said substantially condensed first stream and to expand it to said lower pressure, said second expansion means being further connected to said distillation column to supply said expanded cooled first stream to said distillation column at a first mid-column feed position;

(4) said first cooling means being connected to said dividing means to receive said second stream and to cool it;

(5) said first expansion means being connected to said first cooling means to receive said cooled second stream and to expand it to said lower pressure, said first expansion means being further connected to said distillation column to supply said expanded cooled second stream to said distillation column at a second mid-column feed position;

(6) vapor withdrawing means connected to said distillation column to receive a vapor distillation stream from a region of said distillation column below said expanded cooled second stream;

(7) heat exchange means connected to said vapor withdrawing means to receive said vapor distillation stream and cool it sufficiently to condense at least a part of it;

(8) separating means connected to said heat exchange means to receive said partially condensed distillation stream and separate it, thereby forming a residual vapor stream and a condensed stream, said separating means being further connected to said distillation column to supply at least a portion of said condensed stream to said distillation column at a top feed position;

(9) combining means connected to said distillation column and said separating means to receive said overhead vapor stream and said residual vapor stream and form a combined vapor stream;

(10) said combining means being further connected to said heat exchange means to direct at least a portion of said combined vapor stream into heat exchange relation with said vapor distillation stream and heat said combined vapor stream, thereby to supply at least a portion of the cooling of step (7), and thereafter discharging at least a portion of said heated combined vapor stream as said volatile residue gas fraction; and

(11) control means adapted to regulate the quantities and temperatures of said feed streams to said distillation column to maintain the overhead temperature of said distillation column at a temperature whereby the major portions of the components in said relatively less volatile fraction are recovered.

27. In an apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a distillation column connected to receive said further cooled stream, said distillation column being adapted to separate said further cooled stream into an overhead vapor stream and said relatively less volatile fraction;

the improvement wherein said apparatus includes (1) said first cooling means being adapted to cool said feed gas under pressure sufficiently to partially condense it;

(2) first separating means connected to said first cooling means to receive said partially condensed feed and to separate it into a vapor stream and at least one liquid stream;

(3) dividing means connected to said first separating means to receive said vapor stream and to divide it into first and second streams;

(4) second cooling means connected to said dividing means to receive said first stream and to cool it sufficiently to substantially condense it;

(5) second expansion means connected to said second cooling means to receive said substantially condensed first stream and to expand it to said lower pressure, said second expansion means being further connected to said distillation column to supply said expanded cooled first stream to said distillation column at a first mid-column feed position;

(6) said first expansion means being connected to said dividing means to receive said second stream and to expand it to said lower pressure, said first expansion means being further connected to said distillation column to supply said expanded second stream to said distillation column at a second mid-column feed position;

(7) third expansion means connected to said first separating means to receive at least a portion of said at least one liquid stream and to expand it to said lower pressure, said third expansion means being further connected to said distillation column to supply said expanded liquid stream to said distillation column at a third mid-column feed position;

(8) vapor withdrawing means connected to said distillation column to receive a vapor distillation stream from a region of said distillation column below said expanded second stream;

(9) heat exchange means connected to said vapor withdrawing means to receive said vapor distillation stream and cool it sufficiently to condense at least a part of it;

(10) second separating means connected to said heat exchange means to receive said partially condensed distillation stream and separate it, thereby forming a residual vapor stream and a condensed stream, said second separating means being further connected to said distillation column to supply at least a portion of said condensed stream to said distillation column at a top feed position;

(11) said distillation column being further connected to said heat exchange means to direct at least a portion of said overhead vapor stream separated therein into heat exchange relation with said vapor distillation stream and heat said overhead vapor stream, thereby to supply at least a portion of the cooling of step (9), and thereafter discharging at least a portion of said heated overhead vapor stream as said volatile residue gas fraction; and

(12) control means adapted to regulate the quantities and temperatures of said feed streams to said distillation column to maintain the overhead temperature of said distillation column at a temperature whereby the major portions of the components in said relatively less volatile fraction are recovered.

28. In an apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a distillation column connected to receive said further cooled stream, said distillation column being adapted to separate said further cooled stream into an overhead vapor stream and said relatively less volatile fraction;

the improvement wherein said apparatus includes (1) said first cooling means being adapted to cool said feed gas under pressure sufficiently to partially condense it;

(2) first separating means connected to said first cooling means to receive said partially condensed feed and to separate it into a vapor stream and at least one liquid stream;

(3) dividing means connected to said first separating means to receive said vapor stream and to divide it into first and second streams;

(4) second cooling means connected to said dividing means to receive said first stream and to cool it sufficiently to substantially condense it;

(5) second expansion means connected to said second cooling means to receive said substantially condensed first stream and to expand it to said lower pressure, said second expansion means being further connected to said distillation column to supply said expanded cooled first stream to said distillation column at a first mid-column feed position;

(6) said first expansion means being connected to said dividing means to receive said second stream and to expand it to said lower pressure, said first expansion means being further connected to said distillation column to supply said expanded second stream to said distillation column at a second mid-column feed position;

(7) third expansion means connected to said first separating means to receive at least a portion of said at least one liquid stream and to expand it to said lower pressure, said third expansion means being further connected to said distillation column to supply said expanded liquid stream to said distillation column at a third mid-column feed position;

(8) vapor withdrawing means connected to said distillation column to receive a vapor distillation stream from a region of said distillation column below said expanded second stream;

(9) heat exchange means connected to said vapor withdrawing means to receive said vapor distillation stream and cool it sufficiently to condense at least a part of it;

(10) second separating means connected to said heat exchange means to receive said partially condensed distillation stream and separate it, thereby forming a residual vapor stream and a condensed stream, said second separating means being further connected to said distillation column to supply at least a portion of said condensed stream to said distillation column at a top feed position;

(11) combining means connected to said distillation column and said second separating means to receive said overhead vapor stream and said residual vapor stream and form a combined vapor stream;

(12) said combining means being further connected to said heat exchange means to direct at least a portion of said combined vapor stream into heat exchange relation with said vapor distillation stream and heat said combined vapor stream, thereby to supply at least a portion of the cooling of step (9), and thereafter discharging at least a portion of said heated combined vapor stream as said volatile residue gas fraction; and

(13) control means adapted to regulate the quantities and temperatures of said feed streams to said distillation column to maintain the overhead temperature of said distillation column at a temperature whereby the major portions of the components in said relatively less volatile fraction are recovered.

29. In an apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a distillation column connected to receive said further cooled stream, said distillation column being adapted to separate said further cooled stream into an overhead vapor stream and said relatively less volatile fraction;

the improvement wherein said apparatus includes (1) said first cooling means being adapted to cool said feed gas under pressure sufficiently to partially condense it;

(2) first separating means connected to said first cooling means to receive said partially condensed feed and to separate it into a vapor stream and at least one liquid stream;

(3) dividing means connected to said first separating means to receive said vapor stream and to divide it into first and second streams;

(4) combining means connected to said dividing means and said first separating means to receive said first stream and at least a portion of said at least one liquid stream and form a combined stream;

(5) second cooling means connected to said combining means to receive said combined stream and to cool it sufficiently to substantially condense it;

(6) second expansion means connected to said second cooling means to receive said substantially condensed combined stream and to expand it to said lower pressure, said second expansion means being further connected to said distillation column to supply said expanded cooled combined stream to said distillation column at a first mid-column feed position;

(7) said first expansion means being connected to said dividing means to receive said second stream and to expand it to said lower pressure, said first expansion means being further connected to said distillation column to supply said expanded second stream to said distillation column at a second mid-column feed position;

(8) third expansion means being connected to said first separating means to receive any remaining portion of said at least one liquid stream and to expand it to said lower pressure, said third expansion means being further connected to said distillation column to supply said expanded liquid stream to said distillation column at a third mid-column feed position;

(9) vapor withdrawing means connected to said distillation column to receive a vapor distillation stream from a region of said distillation column below said expanded second stream;

(10) heat exchange means connected to said vapor withdrawing means to receive said vapor distillation stream and cool it sufficiently to condense at least a part of it;

(11) second separating means connected to said heat exchange means to receive said partially condensed distillation stream and separate it, thereby forming a residual vapor stream and a condensed stream, said second separating means being further connected to said distillation column to supply at least a portion of said condensed stream to said distillation column at a top feed position;

(12) said distillation column being further connected to said heat exchange means to direct at least a portion of said overhead vapor stream separated therein into heat exchange relation with said vapor distillation stream and heat said overhead vapor stream, thereby to supply at least a portion of the cooling of step (10), and thereafter discharging at least a portion of said heated overhead vapor stream as said volatile residue gas fraction; and

(13) control means adapted to regulate the quantities and temperatures of said feed streams to said distillation column to maintain the overhead temperature of said distillation column at a temperature whereby the major portions of the components in said relatively less volatile fraction are recovered.

30. In an apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a distillation column connected to receive said further cooled stream, said distillation column being adapted to separate said further cooled stream into an overhead vapor stream and said relatively less volatile fraction;

the improvement wherein said apparatus includes (1) said first cooling means being adapted to cool said feed gas under pressure sufficiently to partially condense it;

(2) first separating means connected to said first cooling means to receive said partially condensed feed and to separate it into a vapor stream and at least one liquid stream;

(3) dividing means connected to said first separating means to receive said vapor stream and to divide it into first and second streams;

(4) first combining means connected to said dividing means and said first separating means to receive said first stream and at least a portion of said at least one liquid stream and form a combined stream;

(5) second cooling means connected to said first combining means to receive said combined stream and to cool it sufficiently to substantially condense it;

(6) second expansion means connected to said second cooling means to receive said substantially condensed combined stream and to expand it to said lower pressure, said second expansion means being further connected to said distillation column to supply said expanded cooled combined stream to said distillation column at a first mid-column feed position;

(7) said first expansion means being connected to said dividing means to receive said second stream and to expand it to said lower pressure, said first expansion means being further connected to said distillation column to supply said expanded second stream to said distillation column at a second mid-column feed position;

(8) third expansion means being connected to said first separating means to receive any remaining portion of said at least one liquid stream and to expand it to said lower pressure, said third expansion means being further connected to said distillation column to supply said expanded liquid stream to said distillation column at a third mid-column feed position;

(9) vapor withdrawing means connected to said distillation column to receive a vapor distillation stream from a region of said distillation column below said expanded second stream;

(10) heat exchange means connected to said vapor withdrawing means to receive said vapor distillation stream and cool it sufficiently to condense at least a part of it;

(11) second separating means connected to said heat exchange means to receive said partially condensed distillation stream and separate it, thereby forming a residual vapor stream and a condensed stream, said second separating means being further connected to said distillation column to supply at least a portion of said condensed stream to said distillation column at a top feed position;

(12) second combining means connected to said distillation column and said second separating means to receive said overhead vapor stream and said residual vapor stream and form a combined vapor stream;

(13) said second combining means being further connected to said heat exchange means to direct at least a portion of said combined vapor stream into heat exchange relation with said vapor distillation stream and heat said combined vapor stream, thereby to supply at least a portion of the cooling of step (10), and thereafter discharging at least a portion of said heated combined vapor stream as said volatile residue gas fraction; and

(14) control means adapted to regulate the quantities and temperatures of said feed streams to said distillation column to maintain the overhead temperature of said distillation column at a temperature whereby the major portions of the components in said relatively less volatile fraction are recovered.

31. In an apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a distillation column connected to receive said further cooled stream, said distillation column being adapted to separate said further cooled stream into an overhead vapor stream and said relatively less volatile fraction;

the improvement wherein said apparatus includes (1) dividing means prior to said first cooling means to divide said feed gas into first and second streams;

(2) second cooling means connected to said dividing means to receive said first stream and to cool it sufficiently to substantially condense it;

(3) second expansion means connected to said second cooling means to receive said substantially condensed first stream and to expand it to said lower pressure, said second expansion means being further connected to said distillation column to supply said expanded cooled first stream to said distillation column at a first mid-column feed position;

(4) said first cooling means being connected to said first dividing means to receive said second stream, said first cooling means being adapted to cool said second stream under pressure sufficiently to partially condense it;

(5) first separating means connected to said first cooling means to receive said partially condensed second stream and to separate it into a vapor stream and at least one liquid stream;

(6) said first expansion means being connected to said first separating means to receive said vapor stream and to expand it to said lower pressure, said first expansion means being further connected to said distillation column to supply said expanded vapor stream to said distillation column at a second mid-column feed position;

(7) third expansion means connected to said first separating means to receive at least a portion of said at least one liquid stream and to expand it to said lower pressure, said third expansion means being further connected to said distillation column to supply said expanded liquid stream to said distillation column at a third mid-column feed position;

(8) vapor withdrawing means connected to said distillation column to receive a vapor distillation stream from a region of said distillation column below said expanded vapor stream;

(9) heat exchange means connected to said vapor withdrawing means to receive said vapor distillation stream and cool it sufficiently to condense at least a part of it;

(10) second separating means connected to said heat exchange means to receive said partially condensed distillation stream and separate it, thereby forming a residual vapor stream and a condensed stream, said second separating means being further connected to said distillation column to supply at least a portion of said condensed stream to said distillation column at a top feed position;

(11) said distillation column being further connected to said heat exchange means to direct at least a portion of said overhead vapor stream separated therein into heat exchange relation with said vapor distillation stream and heat said overhead vapor stream, thereby to supply at least a portion of the cooling of step (9), and thereafter discharging at least a portion of said heated overhead vapor stream as said volatile residue gas fraction; and

(12) control means adapted to regulate the quantities and temperatures of said feed streams to said distillation column to maintain the overhead temperature of said distillation column at a temperature whereby the major portions of the components in said relatively less volatile fraction are recovered.

32. In an apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a distillation column connected to receive said further cooled stream, said distillation column being adapted to separate said further cooled stream into an overhead vapor stream and said relatively less volatile fraction;

the improvement wherein said apparatus includes (1) dividing means prior to said first cooling means to divide said feed gas into first and second streams;

(2) second cooling means connected to said dividing means to receive said first stream and to cool it sufficiently to substantially condense it;

(3) second expansion means connected to said second cooling means to receive said substantially condensed first stream and to expand it to said lower pressure, said second expansion means being further connected to said distillation column to supply said expanded cooled first stream to said distillation column at a first mid-column feed position;

(4) said first cooling means being connected to said first dividing means to receive said second stream, said first cooling means being adapted to cool said second stream under pressure sufficiently to partially condense it;

(5) first separating means connected to said first cooling means to receive said partially condensed second stream and to separate it into a vapor stream and at least one liquid stream;

(6) said first expansion means being connected to said first separating means to receive said vapor stream and to expand it to said lower pressure, said first expansion means being further connected to said distillation column to supply said expanded vapor stream to said distillation column at a second mid-column feed position;

(7) third expansion means connected to said first separating means to receive at least a portion of said at least one liquid stream and to expand it to said lower pressure, said third expansion means being further connected to said distillation column to supply said expanded liquid stream to said distillation column at a third mid-column feed position;

(8) vapor withdrawing means connected to said distillation column to receive a vapor distillation stream from a region of said distillation column below said expanded vapor stream;

(9) heat exchange means connected to said vapor withdrawing means to receive said vapor distillation stream and cool it sufficiently to condense at least a part of it;

(10) second separating means connected to said heat exchange means to receive said partially condensed distillation stream and separate it, thereby forming a residual vapor stream and a condensed stream, said second separating means being further connected to said distillation column to supply at least a portion of said condensed stream to said distillation column at a top feed position;

(11) combining means connected to said distillation column and said second separating means to receive said overhead vapor stream and said residual vapor stream and form a combined vapor stream;

(12) said combining means being further connected to said heat exchange means to direct at least a portion of said combined vapor stream into heat exchange relation with said vapor distillation stream and heat said combined vapor stream, thereby to supply at least a portion of the cooling of step (9), and thereafter discharging at least a portion of said heated combined vapor stream as said volatile residue gas fraction; and

(13) control means adapted to regulate the quantities and temperatures of said feed streams to said distillation column to maintain the overhead temperature of said distillation column at a temperature whereby the major portions of the components in said relatively less volatile fraction are recovered.

33. In an apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a distillation column connected to receive said further cooled stream, said distillation column being adapted to separate said further cooled stream into a vapor distillation stream and said relatively less volatile fraction;

the improvement wherein said apparatus includes (1) dividing means connected to said first cooling means to receive said cooled stream and to divide it into first and second streams;

(2) second cooling means connected to said dividing means to receive said first stream and to cool it sufficiently to substantially condense it;

(3) second expansion means connected to said second cooling means to receive said substantially condensed first stream and to expand it to said lower pressure, said second expansion means being further connected to a contacting and separating means to supply said expanded cooled first stream to said contacting and separating means at a first mid-column feed position, said contacting and separating means being adapted to produce an overhead vapor stream and a bottom liquid stream;

(4) said first expansion means being connected to said dividing means to receive said second stream and to expand it to said lower pressure, said first expansion means being further connected to said contacting and separating means to supply said expanded second stream to said contacting and separating means at a second mid-column feed position;

(5) said distillation column being connected to said contacting and separating means to receive at least a portion of said bottom liquid stream;

(6) vapor withdrawing means connected to said distillation column to receive a vapor distillation stream from an upper region of said distillation column;

(7) heat exchange means connected to said vapor withdrawing means to receive said vapor distillation stream and cool it sufficiently to condense at least a part of it;

(8) separating means connected to said heat exchange means to receive said partially condensed distillation stream and separate it, thereby forming a residual vapor stream and a condensed stream, said separating means being further connected to said contacting and separating means to supply at least a portion of said condensed stream to said contacting and separating means at a top feed position;

(9) said contacting and separating means being further connected to said heat exchange means to direct at least a portion of said overhead vapor stream separated therein into heat exchange relation with said vapor distillation stream and heat said overhead vapor stream, thereby to supply at least a portion of the cooling of step (7), and thereafter discharging at least a portion of said heated overhead vapor stream as said volatile residue gas fraction; and

(10) control means adapted to regulate the quantities and temperatures of said feed streams to said contacting and separating means to maintain the overhead temperature of said contacting and separating means at a temperature whereby the major portions of the components in said relatively less volatile fraction are recovered.

34. In an apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a distillation column connected to receive said further cooled stream, said distillation column being adapted to separate said further cooled stream into a vapor distillation stream and said relatively less volatile fraction;

the improvement wherein said apparatus includes (1) dividing means connected to said first cooling means to receive said cooled stream and to divide it into first and second streams;

(2) second cooling means connected to said dividing means to receive said first stream and to cool it sufficiently to substantially condense it;

(3) second expansion means connected to said second cooling means to receive said substantially condensed first stream and to expand it to said lower pressure, said second expansion means being further connected to a contacting and separating means to supply said expanded cooled first stream to said contacting and separating means at a first mid-column feed position, said contacting and separating means being adapted to produce an overhead vapor stream and a bottom liquid stream;

(4) said first expansion means being connected to said dividing means to receive said second stream and to expand it to said lower pressure, said first expansion means being further connected to said contacting and separating means to supply said expanded second stream to said contacting and separating means at a second mid-column feed position;

(5) said distillation column being connected to said contacting and separating means to receive at least a portion of said bottom liquid stream;

(6) vapor withdrawing means connected to said distillation column to receive a vapor distillation stream from an upper region of said distillation column;

(7) heat exchange means connected to said vapor withdrawing means to receive said vapor distillation stream and cool it sufficiently to condense at least a part of it;

(8) separating means connected to said heat exchange means to receive said partially condensed distillation stream and separate it, thereby forming a residual vapor stream and a condensed stream, said separating means being further connected to said contacting and separating means to supply at least a portion of said condensed stream to said contacting and separating means at a top feed position;

(9) combining means connected to said contacting and separating means and said separating means to receive said overhead vapor stream and said residual vapor stream and form a combined vapor stream;

(10) said combining means being further connected to said heat exchange means to direct at least a portion of said combined vapor stream into heat exchange relation with said vapor distillation stream and heat said combined vapor stream, thereby to supply at least a portion of the cooling of step (7), and thereafter discharging at least a portion of said heated combined vapor stream as said volatile residue gas fraction; and

(11) control means adapted to regulate the quantities and temperatures of said feed streams to said contacting and separating means to maintain the overhead temperature of said contacting and separating means at a temperature whereby the major portions of the components in said relatively less volatile fraction are recovered.

35. In an apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a distillation column connected to receive said further cooled stream, said distillation column being adapted to separate said further cooled stream into a vapor distillation stream and said relatively less volatile fraction;

the improvement wherein said apparatus includes (1) dividing means prior to said first cooling means to divide said feed gas into first and second streams;

(2) second cooling means connected to said dividing means to receive said first stream and to cool it sufficiently to substantially condense it;

(3) second expansion means connected to said second cooling means to receive said substantially condensed first stream and to expand it to said lower pressure, said second expansion means being further connected to a contacting and separating means to supply said expanded cooled first stream to said contacting and separating means at a first mid-column feed position, said contacting and separating means being adapted to produce an overhead vapor stream and a bottom liquid stream;

(4) said first cooling means being connected to said dividing means to receive said second stream and to cool it;

(5) said first expansion means being connected to said first cooling means to receive said cooled second stream and to expand it to said lower pressure, said first expansion means being further connected to said contacting and separating means to supply said expanded cooled second stream to said contacting and separating means at a second mid-column feed position;

(6) said distillation column being connected to said contacting and separating means to receive at least a portion of said bottom liquid stream;

(7) vapor withdrawing means connected to said distillation column to receive a vapor distillation stream from an upper region of said distillation column;

(8) heat exchange means connected to said vapor withdrawing means to receive said vapor distillation stream and cool it sufficiently to condense at least a part of it;

(9) separating means connected to said heat exchange means to receive said partially condensed distillation stream and separate it, thereby forming a residual vapor stream and a condensed stream, said separating means being further connected to said contacting and separating means to supply at least a portion of said condensed stream to said contacting and separating means at a top feed position;

(10) said contacting and separating means being further connected to said heat exchange means to direct at least a portion of said overhead vapor stream separated therein into heat exchange relation with said vapor distillation stream and heat said overhead vapor stream, thereby to supply at least a portion of the cooling of step (8), and thereafter discharging at least a portion of said heated overhead vapor stream as said volatile residue gas fraction; and

(11) control means adapted to regulate the quantities and temperatures of said feed streams to said contacting and separating means to maintain the overhead temperature of said contacting and separating means at a temperature whereby the major portions of the components in said relatively less volatile fraction are recovered.

36. In an apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a distillation column connected to receive said further cooled stream, said distillation column being adapted to separate said further cooled stream into a vapor distillation stream and said relatively less volatile fraction;

the improvement wherein said apparatus includes (1) dividing means prior to said first cooling means to divide said feed gas into first and second streams;

(2) second cooling means connected to said dividing means to receive said first stream and to cool it sufficiently to substantially condense it;

(3) second expansion means connected to said second cooling means to receive said substantially condensed first stream and to expand it to said lower pressure, said second expansion means being further connected to a contacting and separating means to supply said expanded cooled first stream to said contacting and separating means at a first mid-column feed position, said contacting and separating means being adapted to produce an overhead vapor stream and a bottom liquid stream;

(4) said first cooling means being connected to said dividing means to receive said second stream and to cool it;

(5) said first expansion means being connected to said first cooling means to receive said cooled second stream and to expand it to said lower pressure, said first expansion means being further connected to said contacting and separating means to supply said expanded cooled second stream to said contacting and separating means at a second mid-column feed position;

(6) said distillation column being connected to said contacting and separating means to receive at least a portion of said bottom liquid stream;

(7) vapor withdrawing means connected to said distillation column to receive a vapor distillation stream from an upper region of said distillation column;

(8) heat exchange means connected to said vapor withdrawing means to receive said vapor distillation stream and cool it sufficiently to condense at least a part of it;

(9) separating means connected to said heat exchange means to receive said partially condensed distillation stream and separate it, thereby forming a residual vapor stream and a condensed stream, said separating means being further connected to said contacting and separating means to supply at least a portion of said condensed stream to said contacting and separating means at a top feed position;

(10) combining means connected to said contacting and separating means and said separating means to receive said overhead vapor stream and said residual vapor stream and form a combined vapor stream;

(11) said combining means being further connected to said heat exchange means to direct at least a portion of said combined vapor stream into heat exchange relation with said vapor distillation stream and heat said combined vapor stream, thereby to supply at least a portion of the cooling of step (8), and thereafter discharging at least a portion of said heated combined vapor stream as said volatile residue gas fraction; and

(12) control means adapted to regulate the quantities and temperatures of said feed streams to said contacting and separating means to maintain the overhead temperature of said contacting and separating means at a temperature whereby the major portions of the components in said relatively less volatile fraction are recovered.

37. In an apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a distillation column connected to receive said further cooled stream, said distillation column being adapted to separate said further cooled stream into a vapor distillation stream and said relatively less volatile fraction;

the improvement wherein said apparatus includes (1) said first cooling means being adapted to cool said feed gas under pressure sufficiently to partially condense it;

(2) first separating means connected to said first cooling means to receive said partially condensed feed and to separate it into a vapor stream and at least one liquid stream;

(3) dividing means connected to said first separating means to receive said vapor stream and to divide it into first and second streams;

(4) second cooling means connected to said dividing means to receive said first stream and to cool it sufficiently to substantially condense it;

(5) second expansion means connected to said second cooling means to receive said substantially condensed first stream and to expand it to said lower pressure, said second expansion means being further connected to a contacting and separating means to supply said expanded cooled first stream to said contacting and separating means at a first mid-column feed position, said contacting and separating means being adapted to produce an overhead vapor stream and a bottom liquid stream;

(6) said first expansion means being connected to said dividing means to receive said second stream and to expand it to said lower pressure, said first expansion means being further connected to said contacting and separating means to supply said expanded second stream to said contacting and separating means at a second mid-column feed position;

(7) third expansion means connected to said first separating means to receive at least a portion of said at least one liquid stream and to expand it to said lower pressure, said third expansion means being further connected to said contacting and separating means to supply said expanded liquid stream to said contacting and separating means at a third mid-column feed position;

(8) said distillation column being connected to said contacting and separating means to receive at least a portion of said bottom liquid stream;

(9) vapor withdrawing means connected to said distillation column to receive a vapor distillation stream from an upper region of said distillation column;

(10) heat exchange means connected to said vapor withdrawing means to receive said vapor distillation stream and cool it sufficiently to condense at least a part of it;

(11) second separating means connected to said heat exchange means to receive said partially condensed distillation stream and separate it, thereby forming a residual vapor stream and a condensed stream, said second separating means being further connected to said contacting and separating means to supply at least a portion of said condensed stream to said contacting and separating means at a top feed position;

(12) said contacting and separating means being further connected to said heat exchange means to direct at least a portion of said overhead vapor stream separated therein into heat exchange relation with said vapor distillation stream and heat said overhead vapor stream, thereby to supply at least a portion of the cooling of step (10), and thereafter discharging at least a portion of said heated overhead vapor stream as said volatile residue gas fraction; and

(13) control means adapted to regulate the quantities and temperatures of said feed streams to said contacting and separating means to maintain the overhead temperature of said contacting and separating means at a temperature whereby the major portions of the components in said relatively less volatile fraction are recovered.

38. In an apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a distillation column connected to receive said further cooled stream, said distillation column being adapted to separate said further cooled stream into a vapor distillation stream and said relatively less volatile fraction;

the improvement wherein said apparatus includes (1) said first cooling means being adapted to cool said feed gas under pressure sufficiently to partially condense it;

(2) first separating means connected to said first cooling means to receive said partially condensed feed and to separate it into a vapor stream and at least one liquid stream;

(3) dividing means connected to said first separating means to receive said vapor stream and to divide it into first and second streams;

(4) second cooling means connected to said dividing means to receive said first stream and to cool it sufficiently to substantially condense it;

(5) second expansion means connected to said second cooling means to receive said substantially condensed first stream and to expand it to said lower pressure, said second expansion means being further connected to a contacting and separating means to supply said expanded cooled first stream to said contacting and separating means at a first mid-column feed position, said contacting and separating means being adapted to produce an overhead vapor stream and a bottom liquid stream;

(6) said first expansion means being connected to said dividing means to receive said second stream and to expand it to said lower pressure, said first expansion means being further connected to said contacting and separating means to supply said expanded second stream to said contacting and separating means at a second mid-column feed position;

(7) third expansion means connected to said first separating means to receive at least a portion of said at least one liquid stream and to expand it to said lower pressure, said third expansion means being further connected to said contacting and separating means to supply said expanded liquid stream to said contacting and separating means at a third mid-column feed position;

(8) said distillation column being connected to said contacting and separating means to receive at least a portion of said bottom liquid stream;

(9) vapor withdrawing means connected to said distillation column to receive a vapor distillation stream from an upper region of said distillation column;

(10) heat exchange means connected to said vapor withdrawing means to receive said vapor distillation stream and cool it sufficiently to condense at least a part of it;

(11) second separating means connected to said heat exchange means to receive said partially condensed distillation stream and separate it, thereby forming a residual vapor stream and a condensed stream, said second separating means being further connected to said contacting and separating means to supply at least a portion of said condensed stream to said contacting and separating means at a top feed position;

(12) combining means connected to said contacting and separating means and said second separating means to receive said overhead vapor stream and said residual vapor stream and form a combined vapor stream;

(13) said combining means being further connected to said heat exchange means to direct at least a portion of said combined vapor stream into heat exchange relation with said vapor distillation stream and heat said combined vapor stream, thereby to supply at least a portion of the cooling of step (10), and thereafter discharging at least a portion of said heated combined vapor stream as said volatile residue gas fraction; and

(14) control means adapted to regulate the quantities and temperatures of said feed streams to said contacting and separating means to maintain the overhead temperature of said contacting and separating means at a temperature whereby the major portions of the components in said relatively less volatile fraction are recovered.

39. In an apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a distillation column connected to receive said further cooled stream, said distillation column being adapted to separate said further cooled stream into a vapor distillation stream and said relatively less volatile fraction;

the improvement wherein said apparatus includes (1) said first cooling means being adapted to cool said feed gas under pressure sufficiently to partially condense it;

(2) first separating means connected to said first cooling means to receive said partially condensed feed and to separate it into a vapor stream and at least one liquid stream;

(3) dividing means connected to said first separating means to receive said vapor stream and to divide it into first and second streams;

(4) combining means connected to said dividing means and said first separating means to receive said first stream and at least a portion of said at least one liquid stream and form a combined stream;

(5) second cooling means connected to said combining means to receive said combined stream and to cool it sufficiently to substantially condense it;

(6) second expansion means connected to said second cooling means to receive said substantially condensed combined stream and to expand it to said lower pressure, said second expansion means being further connected to a contacting and separating means to supply said expanded cooled combined stream to said contacting and separating means at a first mid-column feed position, said contacting and separating means being adapted to produce an overhead vapor stream and a bottom liquid stream;

(7) said first expansion means being connected to said dividing means to receive said second stream and to expand it to said lower pressure, said first expansion means being further connected to said contacting and separating means to supply said expanded second stream to said contacting and separating means at a second mid-column feed position;

(8) third expansion means connected to said first separating means to receive any remaining portion of said at least one liquid stream and to expand it to said lower pressure, said third expansion means being further connected to said contacting and separating means to supply said expanded liquid stream to said contacting and separating means at a third mid-column feed position;

(9) said distillation column being connected to said contacting and separating means to receive at least a portion of said bottom liquid stream;

(10) vapor withdrawing means connected to said distillation column to receive a vapor distillation stream from an upper region of said distillation column;

(11) heat exchange means connected to said vapor withdrawing means to receive said vapor distillation stream and cool it sufficiently to condense at least a part of it;

(12) second separating means connected to said heat exchange means to receive said partially condensed distillation stream and separate it, thereby forming a residual vapor stream and a condensed stream, said second separating means being further connected to said contacting and separating means to supply at least a portion of said condensed stream to said contacting and separating means at a top feed position;

(13) said contacting and separating means being further connected to said heat exchange means to direct at least a portion of said overhead vapor stream separated therein into heat exchange relation with said vapor distillation stream and heat said overhead vapor stream, thereby to supply at least a portion of the cooling of step (11), and thereafter discharging at least a portion of said heated overhead vapor stream as said volatile residue gas fraction; and

(14) control means adapted to regulate the quantities and temperatures of said feed streams to said contacting and separating means to maintain the overhead temperature of said contacting and separating means at a temperature whereby the major portions of the components in said relatively less volatile fraction are recovered.

40. In an apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a distillation column connected to receive said further cooled stream, said distillation column being adapted to separate said further cooled stream into a vapor distillation stream and said relatively less volatile fraction;

the improvement wherein said apparatus includes (1) said first cooling means being adapted to cool said feed gas under pressure sufficiently to partially condense it;

(2) first separating means connected to said first cooling means to receive said partially condensed feed and to separate it into a vapor stream and at least one liquid stream;

(3) dividing means connected to said first separating means to receive said vapor stream and to divide it into first and second streams;

(4) first combining means connected to said dividing means and said first separating means to receive said first stream and at least a portion of said at least one liquid stream and form a combined stream;

(5) second cooling means connected to said first combining means to receive said combined stream and to cool it sufficiently to substantially condense it;

(6) second expansion means connected to said second cooling means to receive said substantially condensed combined stream and to expand it to said lower pressure, said second expansion means being further connected to a contacting and separating means to supply said expanded cooled combined stream to said contacting and separating means at a first mid-column feed position, said contacting and separating means being adapted to produce an overhead vapor stream and a bottom liquid stream;

(7) said first expansion means being connected to said dividing means to receive said second stream and to expand it to said lower pressure, said first expansion means being further connected to said contacting and separating means to supply said expanded second stream to said contacting and separating means at a second mid-column feed position;

(8) third expansion means connected to said first separating means to receive any remaining portion of said at least one liquid stream and to expand it to said lower pressure, said third expansion means being further connected to said contacting and separating means to supply said expanded liquid stream to said contacting and separating means at a third mid-column feed position;

(9) said distillation column being connected to said contacting and separating means to receive at least a portion of said bottom liquid stream;

(10) vapor withdrawing means connected to said distillation column to receive a vapor distillation stream from an upper region of said distillation column;

(11) heat exchange means connected to said vapor withdrawing means to receive said vapor distillation stream and cool it sufficiently to condense at least a part of it;

(12) second separating means connected to said heat exchange means to receive said partially condensed distillation stream and separate it, thereby forming a residual vapor stream and a condensed stream, said second separating means being further connected to said contacting and separating means to supply at least a portion of said condensed stream to said contacting and separating means at a top feed position;

(13) second combining means connected to said contacting and separating means and said second separating means to receive said overhead vapor stream and said residual vapor stream and form a combined vapor stream;

(14) said second combining means being further connected to said heat exchange means to direct at least a portion of said combined vapor stream into heat exchange relation with said vapor distillation stream and heat said combined vapor stream, thereby to supply at least a portion of the cooling of step (11), and thereafter discharging at least a portion of said heated combined vapor stream as said volatile residue gas fraction; and

(15) control means adapted to regulate the quantities and temperatures of said feed streams to said contacting and separating means to maintain the overhead temperature of said contacting and separating means at a temperature whereby the major portions of the components in said relatively less volatile fraction are recovered.

41. In an apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a distillation column connected to receive said further cooled stream, said distillation column being adapted to separate said further cooled stream into a vapor distillation stream and said relatively less volatile fraction;

the improvement wherein said apparatus includes (1) dividing means prior to said first cooling means to divide said feed gas into first and second streams;

(2) second cooling means connected to said dividing means to receive said first stream and to cool it sufficiently to substantially condense it;

(3) second expansion means connected to said second cooling means to receive said substantially condensed first stream and to expand it to said lower pressure, said second expansion means being further connected to a contacting and separating means to supply said expanded cooled first stream to said contacting and separating means at a first mid-column feed position, said contacting and separating means being adapted to produce an overhead vapor stream and a bottom liquid stream;

(4) said first cooling means being connected to said first dividing means to receive said second stream, said first cooling means being adapted to cool said second stream under pressure sufficiently to partially condense it;

(5) first separating means connected to said first cooling means to receive said partially condensed second stream and to separate it into a vapor stream and at least one liquid stream;

(6) said first expansion means being connected to said first separating means to receive said vapor stream and to expand it to said lower pressure, said first expansion means being further connected to said contacting and separating means to supply said expanded vapor stream to said contacting and separating means at a second mid-column feed position;

(7) third expansion means connected to said first separating means to receive at least a portion of said at least one liquid stream and to expand it to said lower pressure, said third expansion means being further connected to said contacting and separating means to supply said expanded liquid stream to said contacting and separating means at a third mid-column feed position;

(8) said distillation column being connected to said contacting and separating means to receive at least a portion of said bottom liquid stream;

(9) vapor withdrawing means connected to said distillation column to receive a vapor distillation stream from an upper region of said distillation column;

(10) heat exchange means connected to said vapor withdrawing means to receive said vapor distillation stream and cool it sufficiently to condense at least a part of it;

(11) second separating means connected to said heat exchange means to receive said partially condensed distillation stream and separate it, thereby forming a residual vapor stream and a condensed stream, said second separating means being further connected to said contacting and separating means to supply at least a portion of said condensed stream to said contacting and separating means at a top feed position;

(12) said contacting and separating means being further connected to said heat exchange means to direct at least a portion of said overhead vapor stream separated therein into heat exchange relation with said vapor distillation stream and heat said overhead vapor stream, thereby to supply at least a portion of the cooling of step (10), and thereafter discharging at least a portion of said heated overhead vapor stream as said volatile residue gas fraction; and

(13) control means adapted to regulate the quantities and temperatures of said feed streams to said contacting and separating means to maintain the overhead temperature of said contacting and separating means at a temperature whereby the major portions of the components in said relatively less volatile fraction are recovered.

42. In an apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a distillation column connected to receive said further cooled stream, said distillation column being adapted to separate said further cooled stream into a vapor distillation stream and said relatively less volatile fraction;

the improvement wherein said apparatus includes (1) dividing means prior to said first cooling means to divide said feed gas into first and second streams;

(2) second cooling means connected to said dividing means to receive said first stream and to cool it sufficiently to substantially condense it;

(3) second expansion means connected to said second cooling means to receive said substantially condensed first stream and to expand it to said lower pressure, said second expansion means being further connected to a contacting and separating means to supply said expanded cooled first stream to said contacting and separating means at a first mid-column feed position, said contacting and separating means being adapted to produce an overhead vapor stream and a bottom liquid stream;

(4) said first cooling means being connected to said first dividing means to receive said second stream, said first cooling means being adapted to cool said second stream under pressure sufficiently to partially condense it;

(5) first separating means connected to said first cooling means to receive said partially condensed second stream and to separate it into a vapor stream and at least one liquid stream;

(6) said first expansion means being connected to said first separating means to receive said vapor stream and to expand it to said lower pressure, said first expansion means being further connected to said contacting and separating means to supply said expanded vapor stream to said contacting and separating means at a second mid-column feed position;

(7) third expansion means connected to said first separating means to receive at least a portion of said at least one liquid stream and to expand it to said lower pressure, said third expansion means being further connected to said contacting and separating means to supply said expanded liquid stream to said contacting and separating means at a third mid-column feed position;

(8) said distillation column being connected to said contacting and separating means to receive at least a portion of said bottom liquid stream;

(9) vapor withdrawing means connected to said distillation column to receive a vapor distillation stream from an upper region of said distillation column;

(10) heat exchange means connected to said vapor withdrawing means to receive said vapor distillation stream and cool it sufficiently to condense at least a part of it;

(11) second separating means connected to said heat exchange means to receive said partially condensed distillation stream and separate it, thereby forming a residual vapor stream and a condensed stream, said second separating means being further connected to said contacting and separating means to supply at least a portion of said condensed stream to said contacting and separating means at a top feed position;

(12) combining means connected to said contacting and separating means and said second separating means to receive said overhead vapor stream and said residual vapor stream and form a combined vapor stream;

(13) said combining means being further connected to said heat exchange means to direct at least a portion of said combined vapor stream into heat exchange relation with said vapor distillation stream and heat said combined vapor stream, thereby to supply at least a portion of the cooling of step (10), and thereafter discharging at least a portion of said heated combined vapor stream as said volatile residue gas fraction; and

(14) control means adapted to regulate the quantities and temperatures of said feed streams to said contacting and separating means to maintain the overhead temperature of said contacting and separating means at a temperature whereby the major portions of the components in said relatively less volatile fraction are recovered.

43. The improvement according to claim 23, 24, 25, or 26 wherein (1) a second dividing means is connected to said separating means to divide said condensed stream into at least a first portion and a second portion;

(2) said second dividing means being further connected to said distillation column to supply said first portion to said distillation column at a top feed position; and (3) said second dividing means being further connected to said distillation column to supply said second portion to said distillation column at a feed position in substantially the same region wherein said vapor distillation stream is withdrawn.

44. The improvement according to claim 27, 28, 29, 30, 31, or 32 wherein (1) a second dividing means is connected to said second separating means to divide said condensed stream into at least a first portion and a second portion;

(2) said second dividing means being further connected to said distillation column to supply said first portion to said distillation column at a top feed position; and (3) said second dividing means being further connected to said distillation column to supply said second portion to said distillation column at a feed position in substantially the same region wherein said vapor distillation stream is withdrawn.

45. The improvement according to claim 33, 34, 35, or 36 wherein (1) a second dividing means is connected to said separating means to divide said condensed stream into at least a first portion and a second portion;

(2) said second dividing means being further connected to said contacting and separating means to supply said first portion to said contacting and separating means at a top feed position; and (3) said second dividing means being further connected to said distillation column to supply said second portion to said distillation column at a top feed position.

46. The improvement according to claim 37, 38, 39, 40, 41, or 42 wherein (1) a second dividing means is connected to said second separating means to divide said condensed stream into at least a first portion and a second portion;

(2) said second dividing means being further connected to said contacting and separating means to supply said first portion to said contacting and separating means at a top feed position; and (3) said second dividing means being further connected to said distillation column to supply said second portion to said distillation column at a top feed position.

* * * * *